US005444473A

United States Patent [19]

Hattori et al.

[11] Patent Number: 5,444,473

[45] Date of Patent: Aug. 22, 1995

[54] INK JET RECORDING APPARATUS

[75] Inventors: Yoshifumi Hattori, Yamato; Masashi Kitani; Etsuro Suzuki, Yokohama; Hideo Saikawa, Kawasaki; Masami Kojima; Kenji Kawano, both of Tokyo; Koichi Tanno; Kenji Aono, both of Kawasaki, all of Japan

[73] Assignee: Canon Kabushiki Kaisha, Tokyo, Japan

[21] Appl. No.: 791,122

[22] Filed: Nov. 13, 1991

[30] Foreign Application Priority Data

Nov. 15, 1990 [JP] Japan ..... 2-307061
Nov. 15, 1990 [JP] Japan ..... 2-307063

[51] Int. Cl.[6] ..... B41J 2/175
[52] U.S. Cl. ..... 347/87
[58] Field of Search ..... 346/140 R; 347/86, 87; 400/126

[56] References Cited

U.S. PATENT DOCUMENTS

| | | | |
|---|---|---|---|
| 4,313,124 | 1/1982 | Hara | 346/140 |
| 4,345,262 | 8/1982 | Shirato et al. | 346/140 |
| 4,429,320 | 1/1984 | Hattori et al. | 346/140 |
| 4,459,600 | 7/1984 | Sato et al. | 346/140 |
| 4,463,359 | 7/1984 | Ayata et al. | 346/1.1 |
| 4,558,333 | 12/1985 | Sugitani et al. | 346/140 |
| 4,610,202 | 9/1986 | Ebinuma et al. | 101/364 |
| 4,680,696 | 7/1987 | Ebinuma et al. | 346/75 |
| 4,723,129 | 2/1988 | Endo et al. | 346/1.1 |
| 4,740,796 | 4/1988 | Endo et al. | 346/1.1 |
| 4,771,295 | 9/1988 | Baker et al. | 346/1.1 |
| 4,775,871 | 10/1988 | Abe et al. | 346/140 |
| 4,920,362 | 4/1990 | Cowger | 346/140 R |
| 5,008,688 | 4/1991 | Ebinuma et al. | 346/140 |
| 5,113,199 | 5/1992 | Chan et al. | 346/140 R X |

FOREIGN PATENT DOCUMENTS

| | | |
|---|---|---|
| 0082719 | 6/1983 | European Pat. Off. . |
| 0110499 | 6/1984 | European Pat. Off. . |
| 0375383 | 6/1990 | European Pat. Off. . |
| 54-056847 | 5/1979 | Japan . |
| 59-123670 | 7/1984 | Japan . |
| 59-138461 | 8/1984 | Japan . |
| 60-071260 | 4/1985 | Japan . |
| 60-204355 | 10/1985 | Japan . |
| 2097498 | 4/1990 | Japan . |
| 2293153 | 12/1990 | Japan . |

*Primary Examiner*—Benjamin R. Fuller
*Assistant Examiner*—John Barlow
*Attorney, Agent, or Firm*—Fitzpatrick, Cella, Harper & Scinto

[57] ABSTRACT

An ink storage unit used in an ink jet recording apparatus for recording by ejecting ink comprises a plurality of ink storage chambers, a plurality of movable walls and a mechanism for holding each of the movable walls. Each of the ink storage chambers stores ink. Each of the movable walls is provided in the each ink storage chamber respectively so as to seal stored ink against air, and each movable wall can move according to a change of amount of ink in each ink storage chamber. The mechanism for holding the movable walls exerts a force opposed to a force which is exerted on the each movable wall according to the change of amount of ink, on each of the movable walls so as to make the pressure in each ink storage chamber an appropriate negative pressure.

8 Claims, 19 Drawing Sheets

INK JET RECORDING APPARATUS

BACKGROUND OF THE INVENTION

1. Field of the Invention

The present invention relates to an ink jet recording apparatus, and more particularly, to an ink storage unit for storing ink which is supplied to a recording head of the ink jet recording apparatus.

2. Related Background Art

An ink jet recording system performs recording in a manner that an ejection-energy-generating element provided at a portion communicating with orifice of a recording head, such as a heating element or a piezoelectric element, operates based on recording signals to eject ink droplets from the orifice, and to attach the ejected ink droplets to a recording medium. This system has such an advantage that high speed recording is possible and operation noises generated by-recording are fairly low, and is recently in the wide use in printers.

The configuration of an ink supplying system in the above recording system is as follows: Ink which is stored in an ink tank as an ink storage member, is supplied to a recording head via an ink supplying route member such as la tube. The ink supplied to the recording head is temporarily stored in an ink temporary storage portion such as a common liquid chamber, and then is supplied into ink paths in accordance with the ink ejection, the ink paths communicating with orifices correspondingly, an ejection energy generating element being provided in each ink path.

A pressure exerted on the ink in the ink supplying system comprising the ink storage member, the ink supplying route member, and the ink paths in the recording head and the like, is always maintained to be lower than the atmospheric pressure (a pressure lower than the atmospheric pressure is hereinafter referred to as a negative pressure). This can prevent ink from leaking out from the orifices of the recording head and an air communication port of the ink storage member, through each of which the ink paths and an inside of the ink storage member communicate with air respectively. An ink supply from the ink storage member to the ink paths, in which ink refilling into the ink paths is included, is mainly performed by the capillary force of the ink paths and the ink supplying tube.

In the above ink supplying system, the above described negative pressure in the ink supplying system is generally obtained by making the pressure of the inside of the ink storage member negative. Some configurations for making the pressure of the inside of the ink storage member negative, will be shown below.

FIG. 1 is a view showing a head cartridge where the recording head and the ink tank is integrally formed. As shown in FIG. 1, in an ink tank 1000 as the ink storage member, a portion where ink is stored communicates with air via an air communicating port (not shown). Moreover, for instance, as disclosed in the U.S. Pat. No. 4,771,295, a porous ink absorber 6000 typified by urethane sponge is housed in the ink storage portion. A force to hold ink, which is caused by a capillarity force of the ink absorber 6000 and is regarded as a virtual negative pressure, maintains the negative pressure in the inside of the ink supplying system composed of a series of members from the ink tank 1000 to the ink paths in a recording head unit IJU.

With respect to another configuration, as shown in FIG. 2, an ink storage portion 230 is made of flexible materials such as rubber, a plastic film, a laminated aluminum film, etc. in the shape of a bag. The inside of the bag and the whole ink supplying system are maintained at a negative pressure by sealing the inside of the ink storage portion 230 against air.

Besides the above configuration for generating the negative pressure, FIG. 3 shows still another configuration of the ink tank. In this configuration, a layer 130 of a liquid is formed on an upper surface of the ink 210 stored in the ink tank 110. The liquid has a specific gravity smaller than that of the ink and will not be mixed with the ink. In this configuration of the ink tank, since the inside of the ink tank communicates with air via an air communicating port 1120, the layer 130 of the liquid moves together with the ink liquid surface according to the ink consumption, and hence the layer can always separate the ink from air.

In the above described conventional ink storage member, as shown in FIG. 1, where the negative pressure is generated by the porous ink absorber which is provided in the ink tank and is typified by urethane sponge, an effective ink capacity (usable ink capacity) for the ink tank volume can not be obtained because of the existence of the ink absorber. In addition, when the amount of the ink in the ink tank decreases, the negative pressure increases to the contrary, and refilling of the ink into the ink paths accompanying the ink ejection can not be performed well. This may cause defective ejection such as non-ejection. In addition, since amount of remaining ink in the ink tank becomes large because of the negative pressure increasing, use efficiency of ink is difficult to raise.

Therefore, in the case where recording is performed by using the above conventional ink tank including the ink absorber so that a sufficient number of recorded sheets of paper can be obtained, there occurs a problem that the ink tank must be enlarged. Moreover, the urethane sponge of a porous absorber is relatively expensive, and its manufacturing process becomes complicated, and hence it is difficult to provide an ink tank of a low manufacturing cost and with high productivity.

In the configuration where the ink storage portion, as shown in FIG. 2, is made of flexible materials such as rubber formed in the shape of a bag, since the inside of the bag is always sealed and the bag is made of flexible materials, when the amount of the ink in the bag decreases in response to the ejection of ink and the like, the pressure in the bag decreases and causes deformation of the bag. As a result, and for the same reason as described above, all the ink in the bag can not be exhausted. Moreover, there also occurs a problem in that the ink tank must be enlarged in order to provide an amount of ink which is sufficient to record on the desired number of sheets of paper.

In the configuration of the ink storage member where the liquid layer is provided in the ink tank as shown in FIG. 3, a desired negative pressure can not be obtained by the ink tank itself. This may not prevent ink from leaking out from orifices of the recording head, and may have adverse effect on the ink ejection by the recording head in the recording apparatus, where the ink tank is mounted on a carriage and the ink in the ink tank vibrates markedly as a result of a movement of the carriage while a recording operation, so that the vibration is transmitted to the ink near the orifices. In addition, in the above configuration, the ink tank is only in the direction shown in FIG. 3. When the ink tank has another attitude or is moved violently, the movable wall, that is, the liquid layer may be destroyed and the ink may leak out via the air communicating port.

As for a configuration for solving the above problems in various kinds of the above ink storage member, for example, Japanese Patent Application Laying-Open No. 204355/1985 proposed by the assignee of the present invention discloses the ink storage member. This ink storage member has a movable wall therein. The movable Wall is disposed in the ink storage member in a manner that edges of the movable wall slidably contacts on internal wall of the ink storage member with one side face of the movable wall contacting ink stored in the ink storage member and with the other side face of the movable wall contacting air. This makes it possible to always maintain the constant negative pressure in the inside of the ink storage member by a friction force exerted on the sliding portion of the movable wall.

However, the ink storage member using the above movable wall has the following subject to be solved, which is associated with a setting of the friction force.

The ink storage member may have various attitudes according to the mount attitude of the recording apparatus on which the ink storage member is mounted. Incidentally, an ink jet recording apparatus of portable type may have various attitudes when transported, and may be subjected to a relatively great external force such as an impact. Consequently, the ink storage member mounted on such an ink jet recording apparatus, which uses the above movable wall, has a configuration that the movable wall must not move against various attitudes or the external force described above, and good ink supply must be always secured. In order to prevent the movable wall from moving easily in the case where a large amount of ink is stored in the ink storage member, it is considered that materials having relatively great friction coefficient may be employed for the movable wall, or that the maximum static friction force is designed to be great by making the contact area between the movable wall and the internal wall of the ink storage member large.

However, in this case, the movable wall may have a difficulty in moving according to the ink consumption by ink ejection or the like. As a result, the negative pressure in the ink storage portion increases excessively, so that the ink supply to the recording head may have a difficulty and then the ink ejection by the recording head may be disabled.

Besides the above described problem of setting the friction force of the movable wall, in the case where a large amount of ink is stored in the ink storage member, there may occur problems associated with the external force exerted on the ink storage member, a force of inertia produced when the ink storage member which moves together with a recording head, is accelerated or is decelerated during the recording operation and the variation of the pressure on ink in the ink storage member which is caused by a change in environmental temperatures or the like.

More specifically, when a large amount of ink is stored, the pressure on ink in the ink storage member fluctuates easily because of the above problems, so that ink may leak out from the orifices of the recording head when the pressure in the ink storage member is high, to the contrary, when the pressure is low, the ink may not be supplied to the recording head.

SUMMARY OF THE INVENTION

It is an object of the present invention to provide an ink storage member which can always supply ink from an ink storage member to a recording head in a good condition and an ink jet recording apparatus provided with the ink storage member.

In the first aspect of the present invention, an ink storage unit used in an ink jet recording apparatus for recording by ejecting ink, comprises:

a plurality of ink storage chambers for storing ink;

a plurality of movable walls each of which is provided in each of the plurality of ink storage chambers respectively, so as to seal the stored ink against air and can move according to a change of amount of the stored ink; and a movable wall holding means for exerting a force opposed to a force which is exerted on each movable wall according to the change of amount of the stored ink, on each of the plurality of movable walls so as to make the pressure in each ink storage chambers an appropriate negative pressure.

Here, the movable wall holding means may have a configuration in which each movable wall contacts a wall of each chamber, and the force opposed may be a friction force caused by the contact.

The movable wall holding means may include an elastic member, and the force opposed may be an elastic force caused by the elastic member.

The ink storage unit may be integrally formed with a recording head for ejecting ink.

The ink storage unit may be used in a state in which the ink storage unit is removably attached to a recording head for ejecting ink.

In the second aspect of the present invention, an ink storage unit used in an ink jet recording apparatus for recording by ejecting ink, comprises:

an ink storage path which is used for storing ink and gas in the ink storage unit;

a movable wall which is provided in the ink storage path so as to seal the stored ink against air and can moves according to a change of amount of the stored ink; and a movable wall holding means for exerting a force opposed to a force which is exerted on the movable wall according to the inflow or the outflow, on each of the movable walls so as to make the pressure in the ink storage path an appropriate negative pressure.

Here, the movable wall holding means may have a configuration in which each movable wall contacts a wall of the each chamber, and force opposed may be a friction force caused by the contact.

The ink storage may be being integrally formed with a recording head for ejecting ink.

The ink storage unit may be used in a state in which the ink storage unit is removably attached to a recording head for ejecting ink.

In the third aspect of the present invention, an ink jet recording apparatus for recording by ejecting ink, comprises:

a recording head for ejecting ink;

an ink storage unit comprising:

a plurality of chambers for storing ink to be supplied to the recording head;

a plurality of movable walls each of which is provided in each of the plurality of ink storage chambers respectively, so as to seal the stored ink against air and can move according to a change of amount of the stored ink;

a movable wall holding means for exerting a force opposed to a force which is exerted on each movable wall according to the inflow or the outflow, on each of the plurality of movable walls so as to make the pressure in each ink storage chamber an appropriate negative pressure; and a signal sending means for sending an electric signal to the recording head to thereby eject ink.

Here, the recording head may have a configuration in which heat energy produces bubbles in ink and ink is ejected by growth of the bubble.

In the fourth aspect of the present invention, an ink storage unit used in an ink jet recording apparatus for recording by ejecting ink, comprises:

an ink storage chamber for storing ink;

a movable wall which is provided in the ink storage chamber so as to seal the stored ink against air and which can move according to a change of amount of the stored ink;

a movable wall holding means for exerting a force opposed to a force which is exerted on the movable wall according to the inflow or the outflow, on the movable wall so as to make the pressure in the ink storage chamber an appropriate negative pressure; and an ink temporary holding means which is provided in an ink supply route communicating with the ink storage chamber and is used for holding ink in the ink supply route according to inflow or outflow of ink into or out of the ink storage chamber respectively.

Here, the movable wall holding means may have a configuration in which each movable wall contacts a wall of each chamber, and the force opposed may be a friction force caused by the contact.

The ink storage unit may be integrally formed with a recording head for ejecting ink.

The ink storage unit may be used in a state in which the ink storage unit is removably attached to a recording head for ejecting ink.

In the fifth aspect of the present invention, an ink jet recording apparatus for recording by ejecting ink, comprises:

a recording head for ejecting ink;

an ink storage unit comprising:

an ink storage chamber for storing ink to be supplied to the recording head;

a movable wall which is provided in the ink storage chamber so as to seal the stored ink against air and which can move according to a change of amount of the stored ink;

a movable wall holding means for exerting a force opposed to a force which is exerted on the movable wall according to the inflow or the outflow, on the movable wall so as to make the pressure in the ink storage chamber an appropriate negative pressure;

an ink temporary holding means which is provided in an ink supply route communicating with the ink storage chamber and is used for holding ink in the ink supply route according to inflow or outflow of ink into or out of the ink storage chamber respectively; and signal sending means for sending an electric signal to the recording head to thereby eject ink.

Here, the recording head may have configuration in which heat energy produces bubbles in ink and ink is ejected by growth of the bubble.

In the sixth aspect of the present invention, an ink storage unit used in an ink jet recording apparatus for recording by ejecting ink, comprises:

a plurality of ink storage chambers;

a plurality of movable walls each of which is provided in each of the plurality of ink storage chambers respectively, so as to seal the stored ink against air and can move according to a change of amount of the stored ink;

a movable wall holding means for exerting a force opposed to a force which is exerted on each movable wall according to the inflow or the outflow, on each of the plurality of movable walls so as to make pressure in the each ink storage chamber an appropriate negative pressure; and an ink temporary holding means which is provided in an ink supply route communicating with each of the ink storage chambers and is used for holding ink in the ink supplying path according to inflow or outflow of ink into or out of each of the ink storage chambers respectively.

In the seventh aspect of the present invention, an ink jet recording apparatus for recording by ejecting ink, comprises:

a recording head for ejecting ink;

an ink storage unit-comprising:

a plurality of ink storage chambers;

a plurality of movable walls each of which is provided in each of the plurality of ink storage chambers respectively, so as to seal the stored ink against air and can move according to a change of amount of the stored ink;

a movable wall holding means for exerting a force opposed to a force which is exerted on each movable wall according to the inflow or the outflow, on each of the plurality of movable walls so as to make the pressure in each ink storage chamber an appropriate negative pressure;

an ink temporary holding means which is provided in an ink supply route communicating with each of the ink storage chambers and is used for holding ink in the ink supplying path according to inflow or outflow of ink into or out of each of the ink storage chambers respectively; and signal sending means for sending an electric signal to the recording head to thereby eject ink.

Here, the recording head may have configuration in which heat energy produces bubbles in ink and ink is ejected by growth of the bubble.

In the eighth aspect of the present invention, an ink storage unit used in an ink jet recording apparatus for recording by ejecting ink, comprises:

an ink storage portion for storing ink; and an ink temporary holding means which is provided in an ink supply route communicating with the ink storage portion and is used for holding ink in the ink supply route according to a change of amount of ink in the ink storage portion.

In the ninth aspect of the present invention, an ink jet recording apparatus for recording by ejecting ink, comprises:

a recording head for ejecting ink;

an ink storage unit comprising:

an ink storage portion for storing ink to be supplied to the recording head;

an ink temporary holding means which is provided in an ink supply route communicating with the ink storage portion and is used for holding ink in the ink supply route according to a change of amount of ink in the ink storage portion.

Here, the recording head may have configuration in which heat energy produces bubbles in ink and ink is ejected by growth of the bubble.

According to the present invention, for example, when ink flows from each of a plurality of the ink storage chamber according to the ink ejection of the recording head, a pressure on the ink in each of the ink storage chambers decreases because of the decrease in ink amount in the respective ink storage chamber. In this case, each of movable walls moves according to the relationship between a pressure in each of the ink storage chambers and the outer atmospheric pressure so that the pressure decrease in each of the ink storage chambers is moderated. As a result, the total of the pressure in the ink storage chamber caused by the above movement of the movable wall and other forces exerted on the movable wall, balances force such as a friction force. The force is exerted on the movable wall by movable wall holding means, so that the movable wall rests at a proper position.

As a result, even if ink is consumed, the pressure in the each of the ink storage chambers is kept constant, for example, a constant negative pressure in the each of the ink storage chambers is maintained in a non-ejection state of the recording head. Consequently, it is hereby possible for the ink holding function of the ink storage unit is to be better performed and ink supply is performed according on demand. Since the force exerted on the each of the movable walls is relatively small because of each of the movable walls and the pressure to each of the movable walls being small, the force by the movable wall holding means can become small, and hence the movable wall can move smoothly.

According to the present invention, a temporary ink holding member is provided. The temporary ink holding member cushions influence caused by a change in the pressure exerted on ink in the ink storage chamber, the change in the pressure being caused by a change in circumstance and operation conditions of the ink storage unit. With this configuration of the temporary ink holding member, pressure is prevented from increasing or decreasing. Additionally, a constant negative pressure is produced in the ink storage chamber by providing the movable wall in the ink storage chamber so that ink can be held. Accordingly, most of the ink in the ink storage chamber can be used up.

The above and other objects, effects, features and advantages of the present invention will become more apparent from the following description of embodiments thereof taken in conjunction with the accompanying drawings.

DETAILED DESCRIPTION OF PREFERRED EMBODIMENTS

FIRST EMBODIMENT

Figure 1:
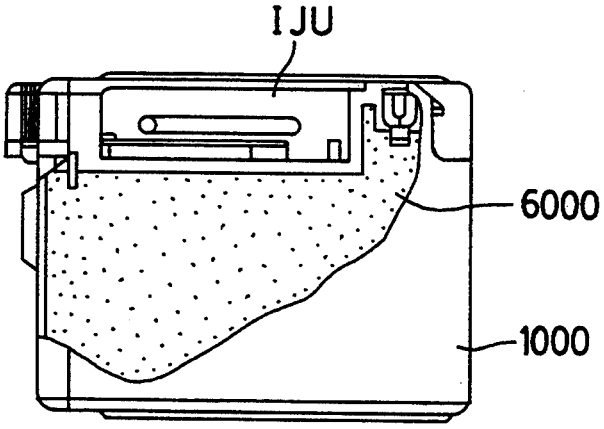
FIG. 1 (PRIOR ART)
FIG. 1 is a plan view, partly in section, showing a conventional ink storage member.
Figure 2:
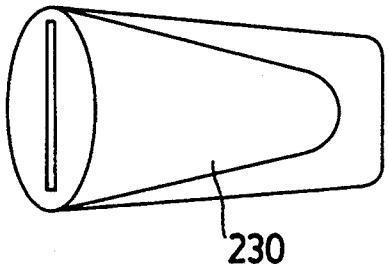
FIG. 2 (PRIOR ART)
FIG. 2 is a perspective view showing another example of a conventional ink storage member.
Figure 3:
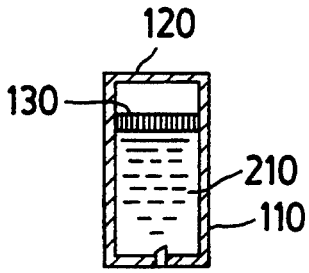
FIG. 3 (PRIOR ART)
FIG. 3 is a longitudinal sectional view showing still another example of a conventional ink storage member.
Figure 4A:
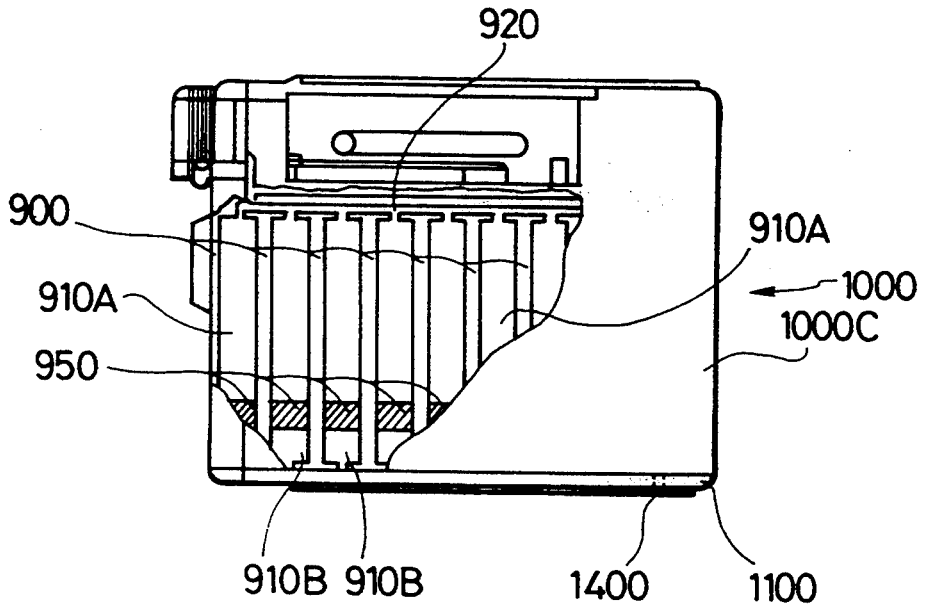
FIG. 4A is a plan view, partly in section, showing a recording head cartridge composed of an ink storage unit and a recording head of a first embodiment of the present invention.
Figure 4B:
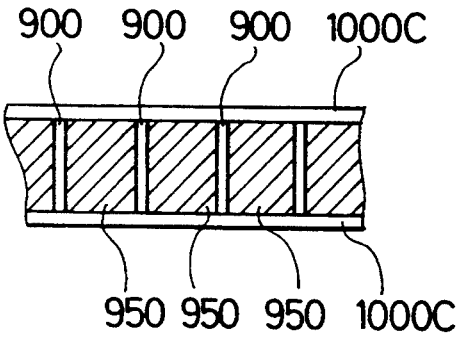
FIG. 4B is a cross sectional side view showing a part of the ink storage unit shown in FIG. 4A.

FIG. 4A is a plan view showing a recording head cartridge of a first embodiment of the present invention integrally formed together with an ink tank as an ink storage unit and a recording head, and FIG. 4B is a cross sectional view showing a part of the ink storage unit shown in FIG. 4A.

FIGS. 5–9 are views for explaining an recording head cartridge IJC which embodies the present invention, a recording head unit IJU and an ink tank IT, both of them constituting IJC, an ink jet recording apparatus IJRA using the recording head cartridge IJC, and a carriage HC on which the recording head cartridge IJC is mounted in the ink jet recording apparatus IJRA, and for explaining relationships among the above units according to the present invention. Incidentally, in the ink jet recording apparatus, an electric signal supplying means for supplying an electric signal as an ink ejection signal to the recording head is provided. With reference to these drawings, configurations of each unit will be described below.

As seen in a later explanation regarding FIG. 5, the recording head cartridge IJC of the first embodiment is composed of the ink tank IT and a recording head unit IJU which are integrally formed, and most part of the recording head cartridge IJC is occupied by the ink tank IT. As seen in FIG. 6, a tip portion of the recording head unit IJU is projected. As described later, the recording head cartridge IJC is fixedly supported by cooperation of a positioning mechanism and an electrical contact portion of the carriage HC provided in the ink jet recording apparatus IJRA (see in FIG. 8), and is removably installed on the carriage HC. When ink in the ink tank IT is used up, the recording head cartridge IJC can be exchanged.

(I) explanation of the configuration of the recording head unit IJU

The recording head unit IJU uses an ink ejection mechanism where, in response to an electric signal, an electrothermal transducer generates thermal energy to produce film boiling in the ink so that the ink ejection is carried out.

Figure 5:
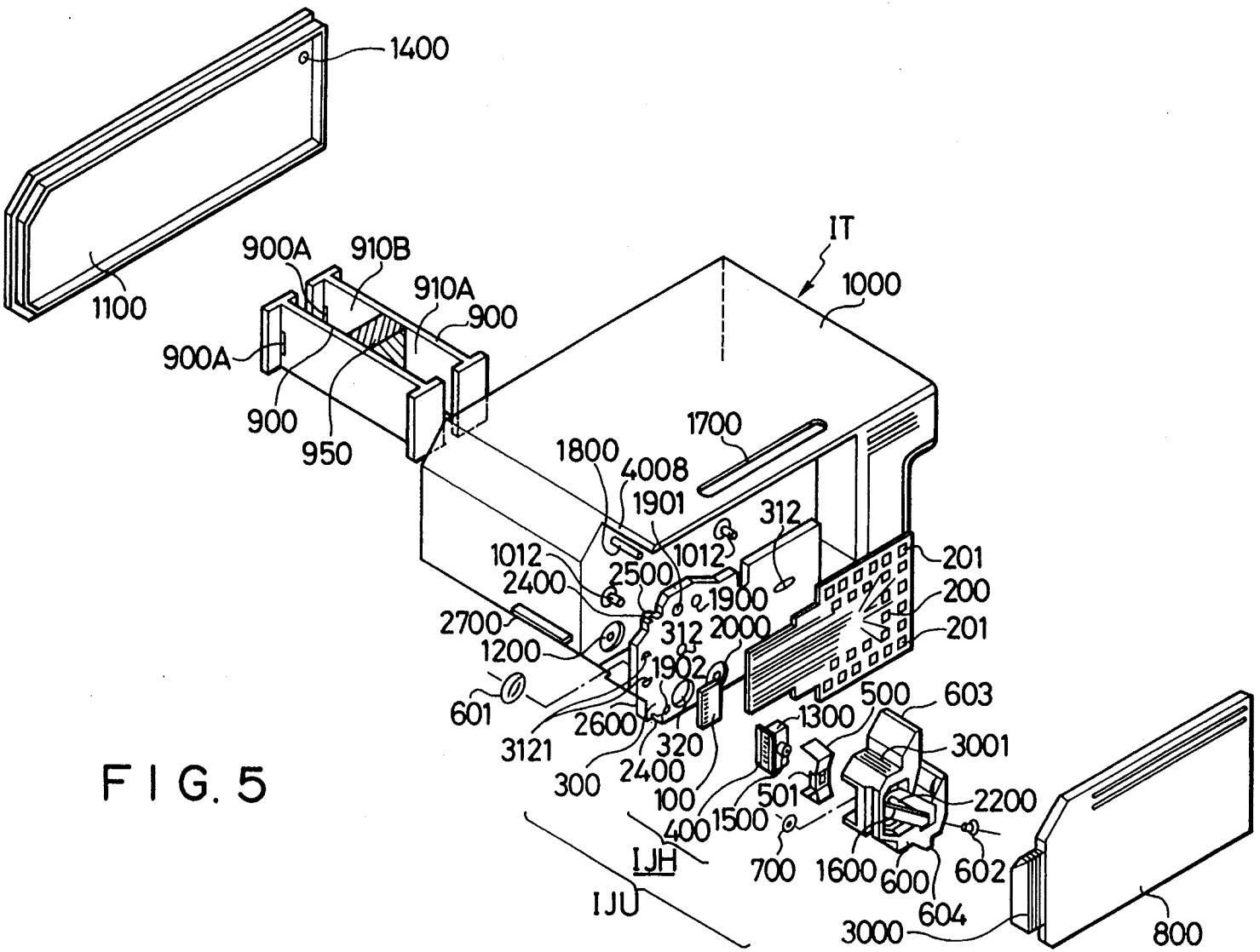
FIG. 5 is an exploded perspective view showing the recording head cartridge shown in FIG. 4A.
Figure 6:
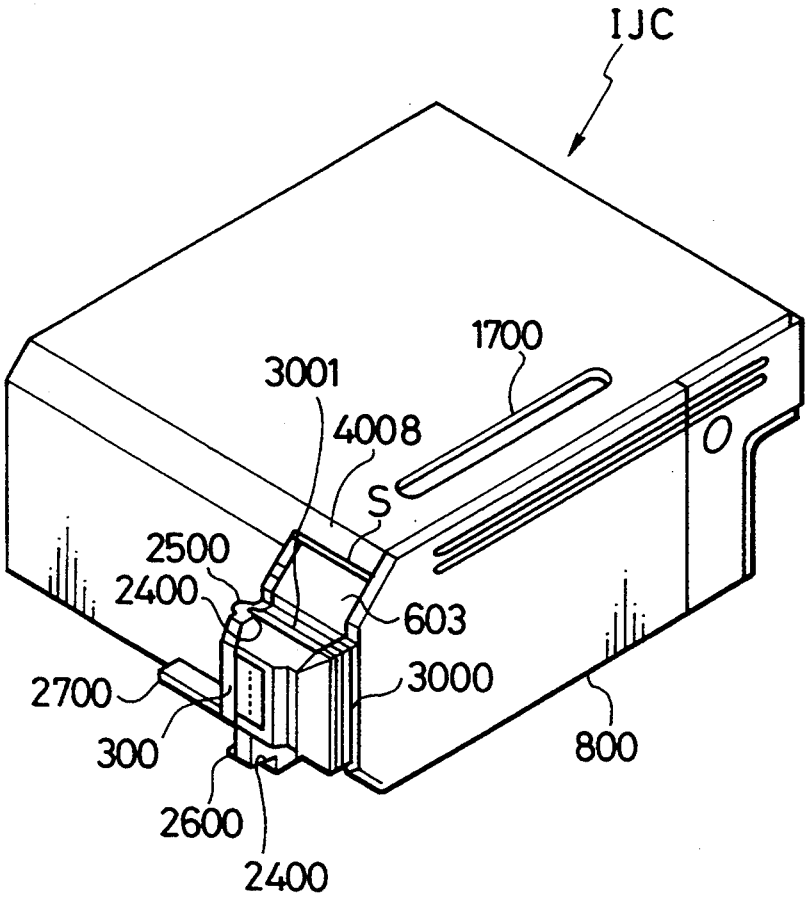
FIG. 6 is a perspective view showing the recording head cartridge shown in FIG. 4A.

In FIG. 5, reference numeral 100 denotes a heater board or substrate. The heater board 100 is composed of electrothermal transducers (ejection heaters) arranged in array geometry and electric wiring which is made of aluminum or the like and is used for feeding power to the electrothermal transducers, which are formed on a silicon substrate plate with a film forming technology. Reference numeral 200 denotes a wiring board connecting to the heater board 100, containing wirings to the electric wiring of the heater board 100 (both ends of the wirings, for example, are fixed by wire bonding) and pads 201 which is disposed at an end of the wiring from the heater board 100 for transferring electric signals from the apparatus IJRA.

Reference numeral 1300 denotes a top plate with grooves which are provided for forming separation walls for defining individual ink path, a common liquid chamber for temporarily storing ink to be fed to each ink path and so on. In addition, the top plate 1300 is a molded unit with an ink inlet 1500 for pouring ink supplied from the ink tank IT into the common liquid chamber and an orifice plate 400 having a plurality of orifices each of which corresponds to each ink path. Polysulfone is more suitable to materials for integrally molding the top plate 1300, but other resinous moldings materials are also available.

Reference numeral 300 denotes a supporting plate, which, for example, is made of metal and supports the wiring board 200 with a plane surface of the supporting plate 300 contacting a reversed surface of the wiring board 200. The supporting plate 200 becomes a base plate of the recording head unit IJU. Reference numeral 500 denotes a pressure spring which is in the shape of character M. A central portion of the M character-shaped spring 500 presses a part of the top plate 1300 with a light pressure, the part corresponding to the common liquid chamber, and a projected portion 501 of the spring 500 intensively presses a part of the top plate 1300, a force by the portion 501 exerting on line-like part which corresponds to ink paths, and more preferably to a region adjacent to the orifices. Foot portions of the pressure spring 500 penetrate holes 3121 formed at the supporting plate 300 and are engaged with a reversed surface of the supporting plate 300, so that the heater board 100 and the top plate 1300 are sandwiched between the supporting plate 300 and the pressure spring 500. In this state, the heater board 100 and the top plate 1300 are fixed to each other by intensively pressing of the pressure spring 500 and the projected portions 501 thereof. Moreover, the supporting plate 300 has positioning holes 312, 1900 and 2000 which engage with positioning projections 1012 and positioning-heat welding projections 1800, 1801 of the ink tank IT, respectively. The supporting plate 300 also has positioning projections 2500 and 2600 for the carriage HC in the apparatus IJRA on the reversed surface of the supporting plate 300. In addition, the supporting plate 300 has a hole 320 through which an ink supplying tube 2200 (described later) penetrates. The ink supplying tube 2200 is provided for supplying ink from the ink tank IT to the recording head unit IJU. The wiring board 200 is attached to the supporting plate 300 with an adhesive or the like. On the supporting plate 300, recess portions 2400 are provided in the vicinity of the positioning projections 2500 and 2600 respectively. In the state that the recording head cartridge IJC has been assembled (see FIG. 6), on three side portions of a tip portion of the recording head unit IJU are formed a plurality of parallel grooves 3000 and 3001 (one side portion is not shown). The recess portions 2400 are positioned at corners of the three side portions to prevent dust, ink or the like from reaching the positioning projections 2500 and 2600. As shown in FIG. 6, a cover 800, on which parallel grooves 3000 are formed, forms an outer wall of the recording head cartridge IJC, and forms a space in which the recording head unit IJU is housed, in cooperation with the ink tank IT. An ink supplying member 600, on which the parallel grooves 3001 are formed, has an ink guiding tube 1600 communicating with the ink supplying tube 2200 in such a manner that one end of the ink guiding tube 1600 is fixed at a portion on the side of the ink supplying tube 2200 like a cantilever. A seal pin 602 is inserted into the ink guiding tube 1600 or the ink supplying tube 2200 so as to secure a capillary force between the fixed end of the ink guiding tube 1600 and the ink supplying tube 2200. Reference numeral 601 denotes a packing to seal a connection portion of the ink tank IT and the ink supplying tube 2200, and reference numeral 700 denotes a filter provided at the end of the ink supplying tube 2200 facing a side of the ink tank.

Since its molded, the ink supplying member 600 is inexpensive and has high positioning accuracy. Moreover, the accuracy degradation in the manufacturing process can be prevented, and a pressure-contact state where the ink inlet 1500 is forcibly pressed by the cantilever-like ink guiding tube 1600, is stable during a mass production. In this embodiment, a more complete communication state is secured by pouring a sealing adhesive from the ink supplying member under the pressure-contact state. The ink supplying member 600 is easily fixed to the supporting plate 300 by the method described below. Pins (not shown) on a reversed surface of the ink supplying member 600 are made to penetrate the holes 1901 and 1902 of the supporting member 300, and portions of the pins projected beyond the reversed surface of the supporting plate 300 are welded. Since the slightly projected welded portions of the pins are fitted in recess on a side surface (not shown) of the ink tank IT, to which the recording head unit IJU is attached, the positioning of the recording head unit IJU is not affected by the projected welded portions.

(II) explanation of the configuration of the ink tank IT

As shown in FIGS. 4A and 5, the ink tank IT is formed in the recording head cartridge case 1000. A plurality of separation walls 900 separate the inside of the ink tank IT into a plurality of chambers respectively, and the separation walls 900 are formed of, e.g., resinous materials. A movable wall 950 is provided in each of the chambers, and is made of silicone rubber. The individual movable wall 950 is slidably supported by the both sides separation walls 900 and top and lower covers 1000C of the cartridge case 1000.

Consequently, a shape of the section of the movable wall, which is perpendicular to a direction in which the movable wall 950 moves, is specified as follows: When the movable wall 950 is incorporated in the chamber as shown in FIG. 4B, the movable wall 950 is tightly incorporated in a portion which is surrounded with the separation walls 900 and the upper and lower covers 1000C of the recording head cartridge case 1000, and is made in a shape similar with and a little larger than a cross sectional area of the chamber 910 so that the movable wall 950 may press the separation walls 900 and the covers 1000C with an appropriate force caused by the elasticity of the movable wall 950. As a result, the individual movable wall 950, as shown in FIG. 4A, can seal the ink storage chamber 910A against an air chamber 910B which communicates with air via a communicating port 1400 (the each air chamber 910B communicates each other via a hole 900A as shown in FIG. 5), and can cause proper friction forces by the elastic pressure of the movable wall when it moves and it is balanced.

With above configuration of the ink tank IT, when ink in the ink tank decreases as the recording head unit consumes ink, the movable wall 950 moves and a volume of the ink storage chamber 910A gradually decreases. Since the friction force is constant, the negative pressure in the ink storage chamber 910A is maintained constant so that good ink supply to the recording head unit IJU is performed and most of ink in the ink tank IT can be used for recording.

Moreover, according to the configuration of this embodiment, various forces which include inertia of the movable wall and is exerted on the movable wall 950 is smaller than forces exerted on a movable wall being disclosed in Japanese Patent Application Laid-open No. 204355/1985, wherein a movable wall is applied to a whole ink storage chamber. This makes setting value of the friction force in a moving portion of each movable wall 950 relatively small. Thus, movement of the individual movable wall 950 in accordance with the decrease in an amount of ink in the ink storage chamber 910A can be performed smoothly.

In the above configuration, each of tip portions of the ink storage chambers 910A are connected to one ink liquid path 920, which is connected to an ink inlet 1200 shown in FIG. 5 for supplying ink to the recording head unit. The friction force generated between the movable wall 950 and the separation wall 900, depends on both the friction coefficient between silicone rubber forming the movable wall and the separation wall 900 and the pressure force with which the silicone rubber presses the separation wall. And in any attitude of the ink tank, it is necessary that the above pressure force make the movable wall stationary against the atmospheric pressure, the negative pressure in the ink storage chamber, an ink weight and the weight of the movable wall. Moreover, it is also necessary that the above pressure force make the movable wall movable at an ink supplying time when ink is refilled after ink ejection. It is preferable that the negative pressure determined by balancing the above friction force with the above various forces exerted on the movable wall is smaller than a suction force caused by a capillary force generated when ink is refilled after ink ejection so that ink supply is performed smoothly.

The above friction force, for example, will be determined as follows: the movable wall 950 completely seals the ink-in the ink storage chamber 910A so that the ink in the ink tank may not leak from an air communicating port 1400. In addition, when the recording head cartridge IJC is in a non-ejection state, the movable wall 950 is not allowed to move in any attitude of the recording head cartridge IJC. In this state, it is preferable that a static friction force generated by contact of the movable wall 950 with both the separation walls 900 and the case covers 1000C of the recording head cartridge IJC, is equal to or greater than a total of a weight of the movable wall 950 and an ink weight to be applied thereto. Assuming that the weight of the movable wall 950 is negligible, and 'S' is an area through which the movable wall 950 is in contact with ink, and 'h' is a pressure head of the ink, it is preferable that the static friction force F which prevents the movable wall 950 from moving by the ink weight, is given by the following expression:

$$F > h \cdot S \qquad \ldots (1)$$

As seen in expression (1), it is apparently that the smaller is the pressure head of the ink or the smaller is the cross sectional area, the smaller is the static friction force required. That is, since the movable wall is divided into many divisions as this embodiment, the static friction force exerted on the individual movable wall becomes small.

In order to eject an ink droplet from the orifice of the recording head unit IJU, ink has need to be supplied from the ink tank IT to the recording head unit IJU. If the negative pressure in the ink storage chamber 910A, is too high when ink is supplied from the ink tank IT to the recording head unit IJU, ink supply shortage occurs. This makes an ejected ink droplet small in volumes so that the density of printed image becomes low, and sometimes makes ink ejection disabled.

The negative pressure in the ink storage chamber is limited and depends on the configuration of the ink ejection outlet or the ink path in the recording head unit IJU. In general, the negative pressure is preferably within −20 gw, more preferably within −15 gw.

Therefore, it is preferable that the static friction force F required to the movable wall satisfies the following expression:

$$S \cdot h < F < 20\ gw \quad \ldots (2)$$

Incidentally, the negative pressure in the ink storage chamber may gradually increase according to the decrease in ink in the ink storage chamber for some reason. In this case, the negative pressure can be maintained approximately constant by decreasing the friction force exerted on the movable wall according to the movement of the movable wall. This is enabled by, e.g., increasing gradually a cross sectional area of the ink storage chamber.

The negative pressure can be also maintained by applying a given force such as an elastic force in a direction where the movable wall moves, instead of the friction force exerted on the movable wall.

Moreover, in a recording apparatus of serial type where the recording head, which is integrally formed with the ink tank in the case of this embodiment, is mounted on the carriage to be moved for recording, since recording is usually performed when the moving velocity of the carriage is constant, the movement thereof does not have effect on the above balance in the movable wall. But, when the carriage accelerates or decelerates, the movable wall and the ink are subjected to an inertia force. For this reason, when the carriage reaches a constant speed, oscillation of the movable wall and the ink caused by the above inertia force must converge promptly. From this point of view, it is preferable that the mass of the movable wall and the pressure head exerted on the movable wall are smaller and the friction force exerted on the movable wall is as large as possible in the friction force range which is determined as described above.

In the above configuration, the ink storage chamber can be completely sealed against air during the ink tank movement, so that fine bubbles are prevented from contaminating the ink due to the mixing of air with the ink, and ink viscosity is prevented from being high due to the contact of the ink with air.

Figure 7:
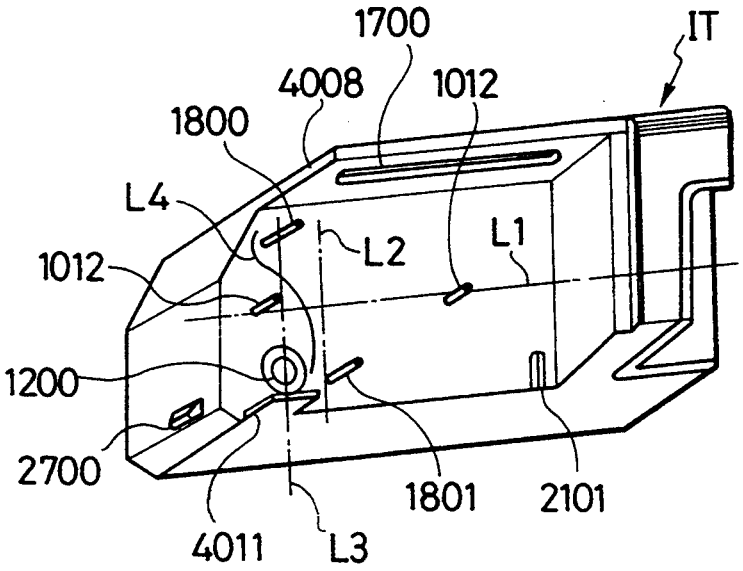
FIG. 7 is a perspective view showing the recording head cartridge shown in FIG. 4A from which the recording head is removed.

FIG. 7 shows a configuration of a recording head unit installation surface on the ink tank IT. In FIG. 7, line L1 passes near a center of arrangement of orifices on an orifice plate 400 (see in FIG. 5) and is perpendicular to the orifice plate 400. In addition, the line L1 is parallel to either a bottom surface of the ink tank IT or a mount-reference surface of the carriage. Two positioning projections 1012 which are provided on the above installation surface and engagic with the two positioning holes 312 at the supporting plate 300 (see in FIG. 5) are on line L1. The height of the positioning projections 1012 is slightly less than the thickness of the supporting plate 300, the positioning projections 1012 perform the positioning of the supporting plate 300 in cooperation with the positioning holes 312. On an extension line of the line L1, a finger 2100 is provided which engages a 90-degree engaging surface 4002 of the positioning hook 4001 provided on the carriage HC, and an action force for positioning of the recording head cartridge to the carriage acts in a surface parallel to the above mount reference surface including the line L1. As shown later in FIG. 8, the above configuration relationship is effective because positioning accuracy of the recording head cartridge is as precise as positioning accuracy of the orifices of the recording head.

Figure 8:
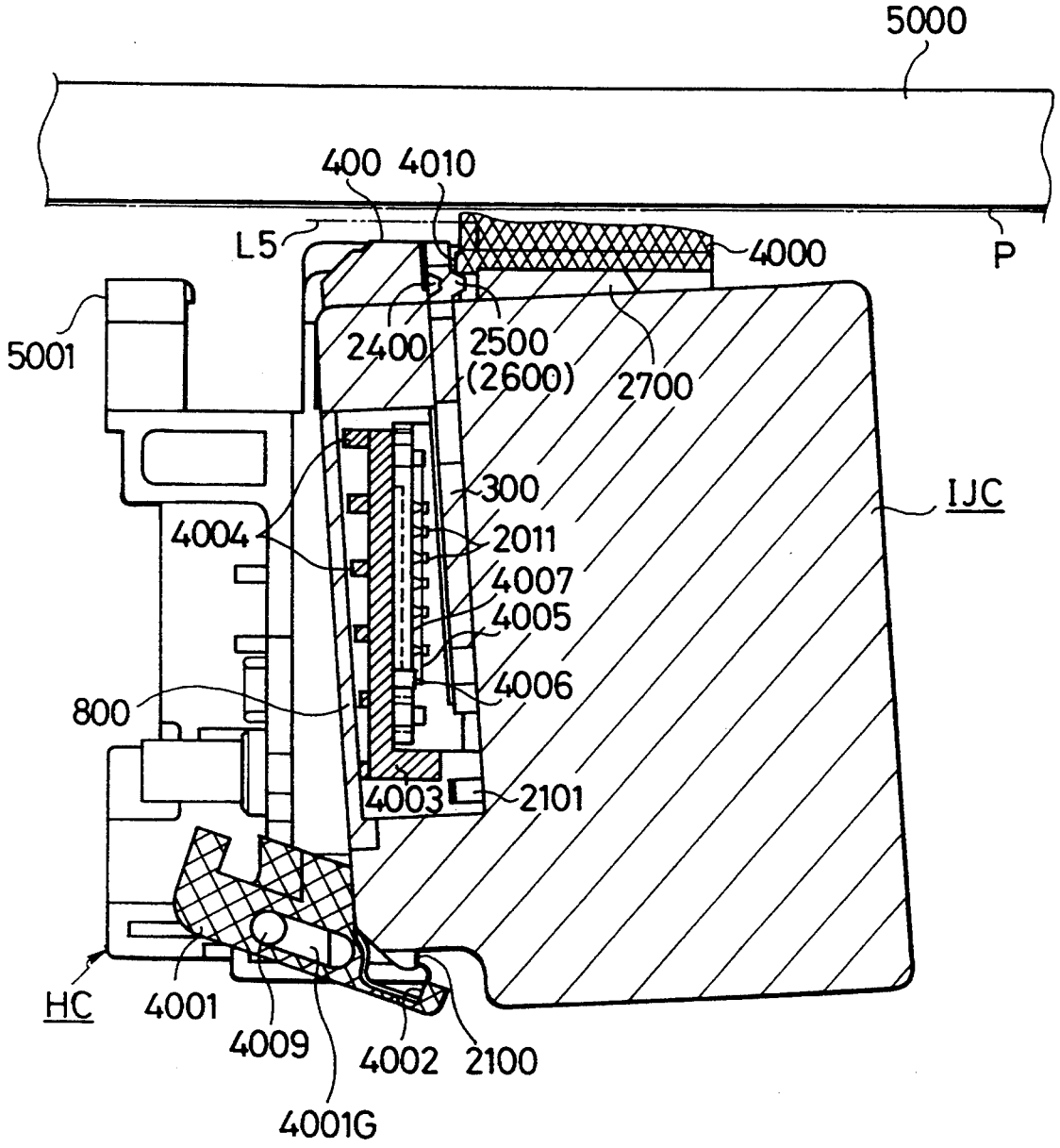
FIG. 8 is a plan view for explaining how to mount the recording head cartridge shown in FIG. 4A on the recording apparatus.

Projections 1800 and 1801 of the ink tank IT which are respectively corresponding to holes 1900 and 2000 for fixing the supporting plate 200 to a side surface of the ink tank IT, are longer than the projections 1012. The projections 1800 and 1801 are used for fixing the supporting plate 300 to the side surface of the ink tank IT by penetrating the holes 1900 and 2000 respectively and then by welding projected portions of the projections 1800 and 1801 beyond the surface of the supporting plate 300. Line L2 is perpendicular to line L1 and passes on the projection 1801, and line L3 is perpendicular to line L1 and passes the projection 1800. Since the center of the ink inlet 1200 is positioned approximately on line L3, the connection state of the ink inlet 1200 and the ink supplying tube 2200 is stable and an adverse effect to this connection state caused by an impact of the drop or the like of the recording head cartridge can be reduced. Moreover, since line L2 does not accord with line L3 and on the above installation surface, the projections 1800 and 1801 are disposed in the vicinity of the projection 1012 of an orifice side, positioning of the recording head unit IJU to the ink tank IT is reinforced. Incidentally, line L4 shows a position corresponding to an outer wall of the ink supplying member 600 when the recording head unit IJU is installed to the ink tank IT. Since the projections 1800 and 1801 are disposed on the line L4, the projections give a sufficient strength against the weight of the tip portion of the recording head unit IJU and give a sufficient positioning accuracy to a tip configuration thereof. As shown in FIG. 8, reference numeral 2700 is a tip flange of the ink tank IT, and is inserted into a groove on a front plate 4000 of the carriage HC so as to prevent a marked displacement of the ink tank. Reference numeral 2101 is a stopper for the carriage, and is provided corresponding to a bar (not shown) of the carriage HC. At the position where the recording head cartridge IJC is turned to be mounted as described later, the stopper goes under the bar. This can maintain the mount position of the recording head cartridge IJC even though an accidental force, which acts upwards or downwards and makes the recording head cartridge deviate from the mount position, acts on the recording head cartridge. The ink tank IT encloses the recording head unit IJU except for a bottom aperture of the recording head cartridge IJC in cooperation with the cover 800 which covers the recording head unit IJU after the unit IJU is installed to the ink tank IT. When the recording head cartridge is mounted on the carriage HC, the bottom aperture, however, is proximately to the carriage HC so that all slides of the recording head unit is substantially covered. Consequently, heat radiated from the recording head IJH into the enclosed space is available for a heat insulating of the enclosed space, but the temperature of the enclosed space slightly rises after a long-period operation. In this embodiment, on a top surface of the recording head cartridge is provided a slit 1700 which is narrower than the enclosed space in widths and promotes natural heat radiation mainly from the supporting plate, as shown in FIGS. 5 and 6. The slit prevents the heat rise and keeps the uniformity of temperature distribution of the whole recording head unit IJU regardless of an environment around the recording head unit.

In the recording head cartridge IJC, as shown in FIG. 5, ink goes out of the ink tank IT, passes through the ink inlet 1200, a hole 320 on the supporting plate 300, an ink inlet on the reversed surface of the ink supplying member 600, and comes into the ink supplying member 600 as shown in FIG. 5. After passing through the inside of the ink supplying member, ink goes into the common liquid chamber of the recording head IJH via the ink guide of the ink supplying member 600, appropriate ink supplying tubes and the ink inlet 1500 on the top plate 1300 of the recording head IJH. As connection portions for communicating ink, for example, a packing such as silicone rubber or butyl rubber is disposed and seals the connection portions to secure the ink liquid paths.

In this embodiment, as materials of the top plate 1300, such an anti-ink resin as polysulfone, polyether sulfone, polyphenylene oxide or polypropylene is used. The top plate 1300 is integrally formed with the orifice plate 400 by using a metal mold.

As described above, the ink supplying member 600, the top plate and orifice plate integral portion and the ink tank 1000 are integrally molded respectively. Thus, the integral molding makes assembly accuracy very high, and is available for improvement in quality in mass production. Moreover, the number of assembly parts can be reduced as compared with that of the conventional ink jet recording apparatus. Consequently, superior desired features can be secured.

In this embodiment of the present invention, as shown in FIGS. 5–7, after assembling is completed, the upper portion 603 of the ink supplying member 600 forms a slit S in cooperation with an end portion 4008 of an upper portion provided with a slot 1700 of the recording head cartridge. A bottom portion 604 of the ink supplying member 600 forms the same slit S (not shown) in cooperation with a thin metal sheet member 4011 (shown in FIG. 7) which is attached with the cover 800 and extends sideward. These slits prompt heat radiation through the slit 1700, and prevent an unnecessary force exerted on the recording head cartridge IJC from being directly exerted on the ink supplying member 600 and the recording head unit IJU.

(III) explanation how to mount the recording head cartridge IJC on the carriage HC In FIG. 8, a platen roller 5000 transports a recording medium P such as paper in a direction from back to front of the drawing. The carriage HC can move along the platen roller 5000. The carriage HC comprises a front plate 4000 of 2 mm thickness provided in front of the recording head cartridge IJC mounted, an electrical connection supporting plate 4003 which has flexible sheet 4005 provided with a pad 2011 corresponding to a pad 201 on a wiring board 200 of the cartridge IJC and a rubber pad sheet 4007 having an elastic force to press the flexible sheet 4005 onto the each pad 2011 from the back surface of the flexible sheet, and a positioning hook 4001 for fixing the recording head cartridge IJC to a predetermined position. The front plate 4000 has two positioning projected surfaces 4010 in a direction perpendicular to the drawing of FIG. 8 corresponding to the positioning projections 2500 and 2600 of the supporting plate 300, and is subjected to a vertical force toward the projected surface 4010 when the cartridge IJC is mounted. For this reason, a plurality of reinforcing ribs (not shown) are provided on a surface of the front plate 4000 on the side of the platen roller 5000, in a direction of the vertical force. The ribs are slightly projected by about 0.1 mm beyond a front surface position $L_5$ of the recording head unit IJU (shown in two short dashed lines) when the cartridge IJC is mounted, so that the ribs can protect a front surface of the recording head. The supporting plate 4003 is provided with a plurality of the reinforcing ribs 4004 disposed in a direction perpendicular to the above described ribs. The sideward projections of the supporting plate 4003 which are formed with the reinforcing ribs 4004 becomes lower and lower away from the platen roller in order to incline the cartridge IJC when mounted as shown in hatched lines in FIG. 8. Moreover, in a direction perpendicular to FIG. 8, the supporting plate 4003 has two positioning surfaces 4006 on the side of the positioning hook for exerting a force on the cartridge IJC, corresponding to the two positioning projected surfaces 4010, so that the electrical contact is made stable. The above force is oriented in a direction opposite to a direction in which the above two positioning projected surfaces 4010 exert a force on the cartridge IJC. The supporting plate forms a pad contact area between the two positioning projected surfaces 4006. The positioning surfaces 4006 uniquely specify a deformation amount of projections on the projection-attached rubber pad sheet 4007 corresponding to the pads 2011. The two positioning surfaces 4006 come in contact with a surface of the wiring board 200 (see FIG. 5) when the cartridge IJC is fixed to a recording enabled position in the carriage HC. In this embodiment, the pads 201 on the side of wiring board 200 are distributed symmetrically with the above described line L1, so that the deformation amount of the projections of the rubber pad sheet 4007 is made uniform to stabilize a contact pressure between the pads 2011 and the pads 201. In this embodiment, the pads 2011 are disposed in an arrangement pattern in which there are upper two lines, lower two lines and two rows.

The positioning hook 4001 has a slot 4001G which engages with a guide shaft 4009. Positioning of the recording head cartridge IJC for the carriage HC is performed by turning the hook 4001 counterclockwise from a position shown in FIG. 8 and then by moving the hook 4001 to the left parallel with the platen roller 5000 by using a space of the slot 4001G. The hook 4001 can be moved by any device, but it is preferable to use a lever or the like. In any case, when the hook 4001 turns counterclockwise, the recording head cartridge IJC moves toward the platen roller 5000, and moves to a position in which the positioning projections 2500 and 2600 can be in contact with the positioning projected surfaces 4010 of the front plate 4000. Then, a hook engaged surface 4002 closely contacts a surface of a finger 2100, and turns the recording head cartridge IJC horizontally around a contact area formed with the positioning projection 2500 and the positioning surface 4010. Eventually, the pads 201 start contacting the pads 2011. As a result, when the positioning hook 4001 is held to a predetermined fixed position, the pads 201 completely contact the pad 2011, and the positioning surface 2500 completely contacts the positioning projected surface 4010, and the engaged surface 4002 contacts the surface of the finger 2100, and the wiring board 200 completely contacts the positioning surface 4006 at the same time. Finally, the recording head cartridge IJC has been completely held by the carriage HC.

Figure 9:
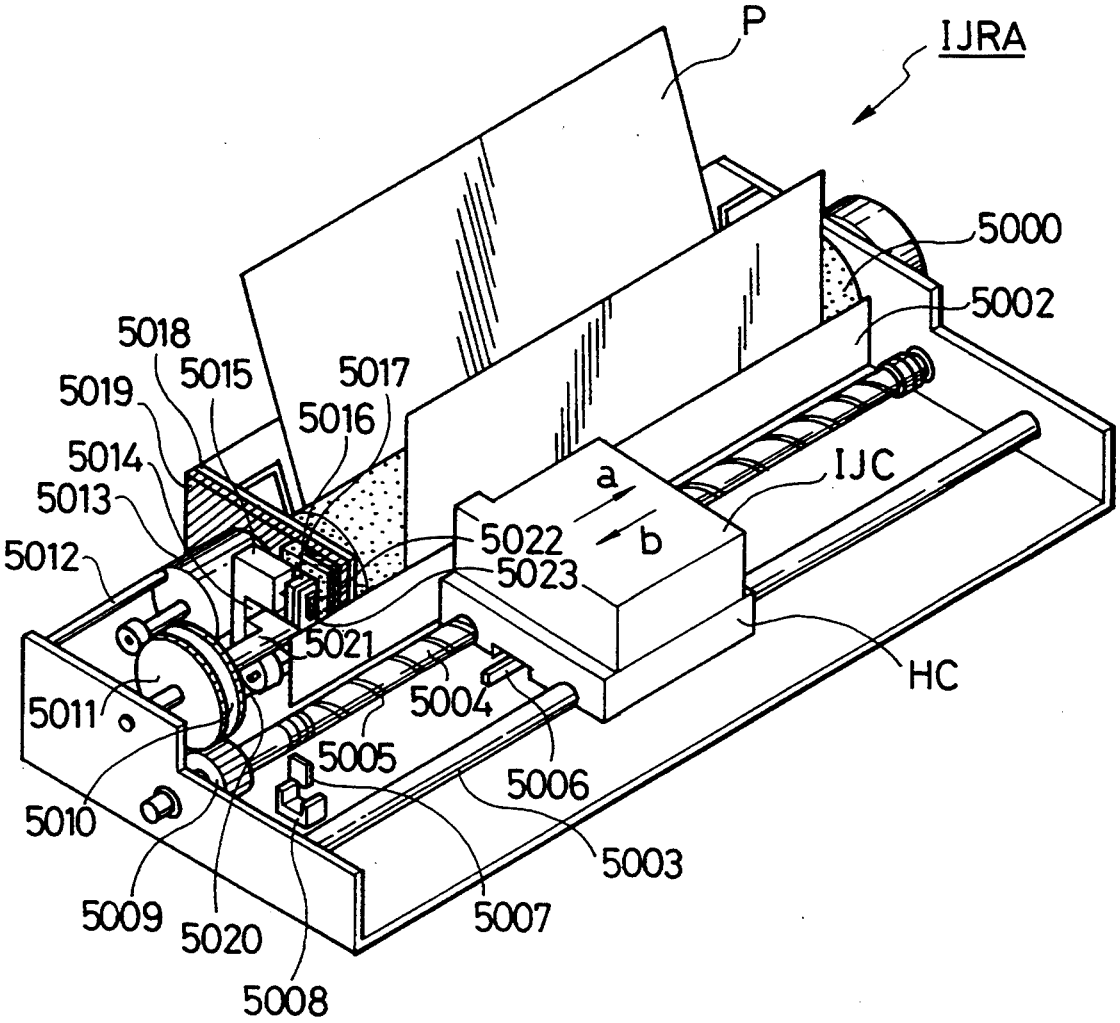
FIG. 9 is a schematic perspective view showing an ink jet recording apparatus on which the recording head cartridge shown in FIG. 4A can be mounted.

Removal of the recording head cartridge IJC can be performed by using the reverse operation of the hook 4001. (IV) outline of the ink jet recording apparatus IJRA FIG. 9 is a schematic perspective view of the ink jet recording apparatus IJRA in accordance with the present invention. A driving force exerted by a driving motor 5013 is transmitted to a leadscrew 5005 via transmission gears 5011, 5009, so that the leadscrew 5005 can rotate in forward or backward directions according to the forward or reverse rotation of a driving motor 5013. The carriage HC can move in both directions indicated by arrows 'a' and 'b' by engaging a pin of the carriage HC (not shown) with a slot 5004 formed on the leadscrew 5005. Reference numeral 5002 is a paper pressure plate which presses a sheet of paper P as a recording medium such as paper onto the platen roller 5000. Reference numerals 5007 and 5008 denote a photo sensor, which detects the home position or the like on the movement of the carriage HC by detecting a lever 5006 of the carriage. Reference numeral 5016 denotes a supporting member of a cap 5022 which caps a front surface of the recording head. Reference numeral 5015 denotes sucking means. The sucking means can make the inside of the cap 5022 a negative pressure to clear ink in the vicinity of the orifices of the recording head through an aperture 5023 in the cap, so that an ejection recovery operation of the recording head is performed. Reference numeral 5017 denotes a cleaning blade and reference numeral 5019 denotes a member for moving the cleaning blade 5017 back and forth. The member 5019 is supported by a supporting plate 5018. It is clear that a well-known cleaning blade is also available for this embodiment. The cleaning blade 5017 and the member 5019 are supported by the apparatus supporting plate 5018. A lever 5021 for starting the suction operation moves according to the movement of a cam 5020 which engages with the carriage HC, so that the lever 5021 controls a change-over of a clutch for changing over the transmission of the driving force of the driving mot or.

When the carriage HC comes to the home position area, the capping, the cleaning and the ejection recovery operations can be performed at their predetermined positions according to the rotation of the leadscrew 5005. In the case where the configuration is made so that a desired operation may be performed with a predetermined timing, any of the above three operations, however, is applicable to this embodiment.

Figure 10:
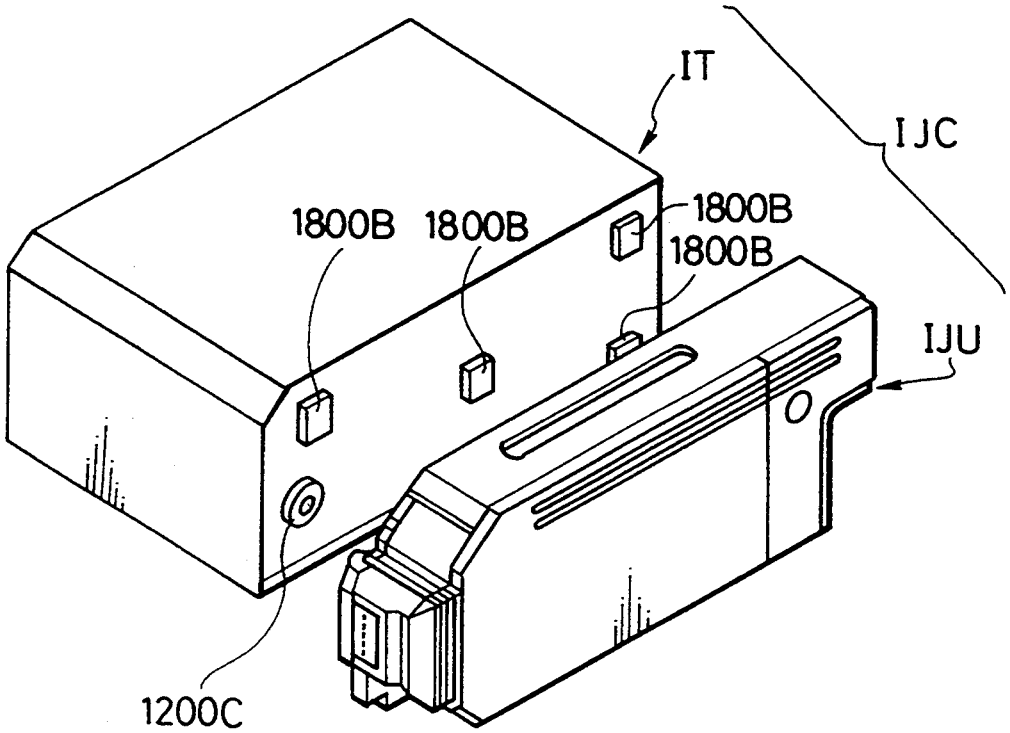
FIG. 10 is an exploded perspective view showing another embodiment of the recording head cartridge of the present invention.

In the above embodiment, an integral configuration of the ink tank and the recording head unit has been explained. It, however, is allowable that the ink tank and the recording head unit are separated and are incorporated as a head cartridge. As shown in FIG. 10, the recording head cartridge IJC can be separated into the ink tank IT and the head unit IJU. When these two portions are integrally incorporated, a projected connector 1200C, which is provided on a side surface of the ink tank IT and includes an ink communicating portion, is closely connected to a recessed connector (not shown), which is provided on the recording head unit IJU and corresponds to the above projected connector 1200C. This allows ink to be supplied from the ink tank IT to the recording head unit IJU. Moreover, besides the above connectors, a plurality of projected portions 1800B provided on the side surface of the ink tank are closely connected to recessed portions (not shown) which are provided on the recording head unit IJU and correspond to the above projected portions. This enables the ink tank IT to be connected to the recording head IJU securely.

The connector 1200C on the ink tank IT and the recessed connector on the recording head unit IJU allow ink to easily flow when connected, and prevent ink from leaking out when disconnected.

When ink is used up in the ink tank IT, the ink tank has only to be exchanged by using the separable configuration described above. Incidentally, the recording head cartridge having the above separable configuration is apparently formed by using ink tanks which are described in embodiments shown below.

Figure 11:
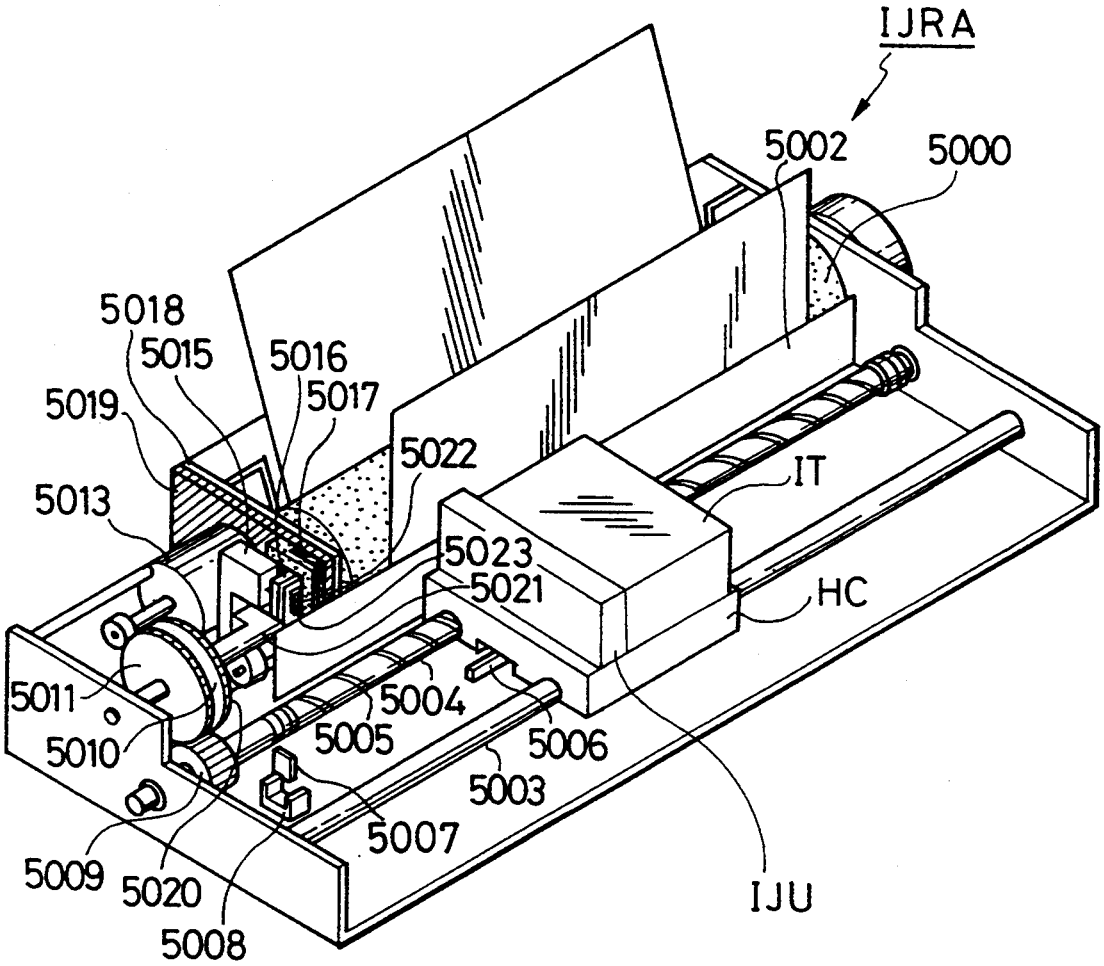
FIG. 11 is a schematic perspective view showing an example of the ink jet recording apparatus using the recording head cartridge shown in FIG. 10.

FIG. 11 shows an example of the ink jet recording apparatus with the separable head cartridge shown in FIG. 10. In this configuration, since portions other than the separable head cartridge are the same as those of the apparatus in FIG. 9, the explanation is omitted.

Figure 12:
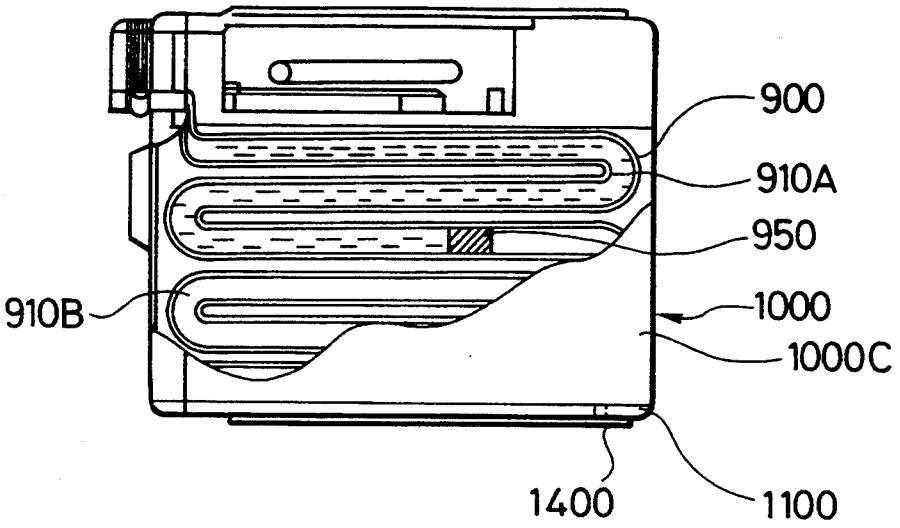
FIG. 12 is a plan view, partly in section, showing the recording head cartridge of a modification of the first embodiment.

FIG. 12 is a plan view, partly in section, showing an ink tank of a modification of first embodiment according to the present invention.

The same reference numerals are used to represent the portions or parts which correspond to those shown in FIGS. 4A and 4B.

In this modification, an ink storage portion 910A and an air part 910B are formed in one continuous ink storage path formed by a separation wall 900 and upper and lower covers 1000C. The cross sectional shape of a movable wall 950 is appropriately determined according to a cross section of the ink storage path as well as first embodiment shown in FIGS. 4A and 4B. The air part 910B is communicated with air via an air communicating port 1400. A negative pressure in the ink storage portion is maintained constant by a friction force caused at a sliding portion of the movable wall 950.

According to the modification, since ink is stored in an ink winding portion, an inertia force exerted on the ink by movement of the ink tank can be cancelled. This reduces pressure fluctuations of the stored ink affected by the movement of the ink tank.

Figure 13:
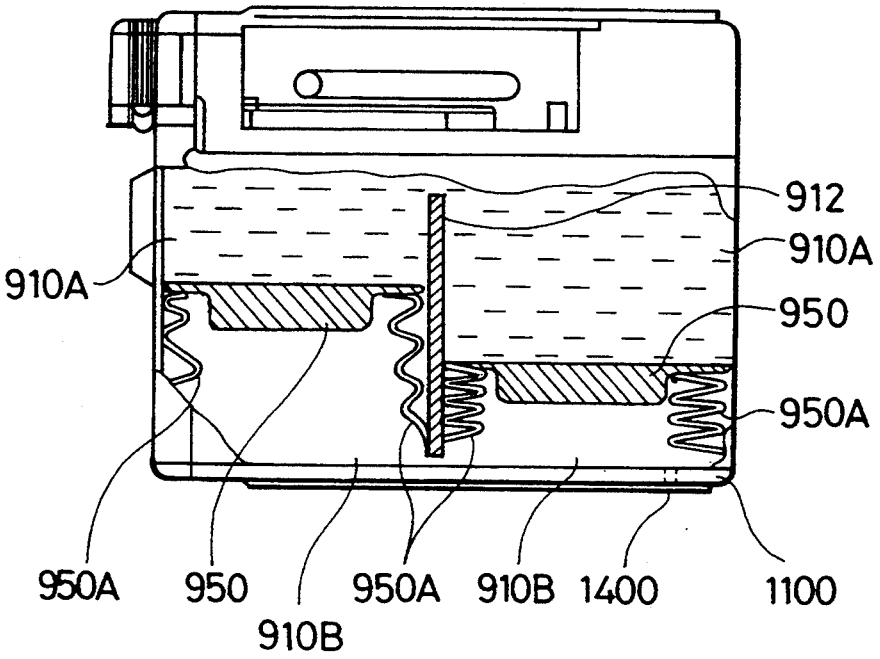
FIG. 13 is a plan view, partly in section, showing the recording head cartridge of another modification of the first embodiment.

FIG. 13 is a plan view, partly in section, showing a recording head cartridge of another modification of first embodiment.

In this modification, the inside of the ink tank is divided into two chambers by a separation wall 912, and in each divided chamber there is disposed a movable wall 950. In the above embodiments, the negative pressure in the ink storage chamber (portion) is obtained by the friction force caused by the movement of the movable wall. In this modification, however, the friction force is relatively small or about zero, and the negative pressure is obtained by pulling the movable wall by an elastic member provided for this purposes. An elastic member 950A is attached to each of the movable walls 950. Reference numeral 1400 is an air communicating port, which supplies air to the left side and right side chambers. When ink is filled in the ink tank, these elastic members 950A shrink as shown in the right side chamber in FIG. 13. As ink is used and then the movable wall moves, they extend as shown in the left side chamber in FIG. 13.

Incidentally, these elastic members 950A exert a force on the movable wall 950 so that a negative pressure of ink may be produced on a side of the recording head. This negative pressure caused by the elastic members, however, is made smaller than an ink holding force produced at the meniscus in an ink path. This is because, if the negative pressure is greater than the ink holding force on the contrary, a meniscus drop or the like is caused so that a good ink ejection is disabled. Elastic materials to be used for the elastic member are preferably those which maintain a constant negative pressure even if a remaining amount of ink changes, such as compound materials constituted by materials of different elastic coefficients, materials of different thicknesses or the like.

In this modification, a chamber in the ink tank is divided into the two chambers by the separation wall. However, the chamber can be divided into more than two small chambers and the same configuration described above may be employed. Incidentally, in those modifications the negative pressure can be adjusted precisely by dividing the chamber into a plurality of small chambers and then by increasing the number of elastic members. At the same time, a force applied to the movable wall caused by the elastic member can be reduced.

SECOND EMBODIMENT

Figure 14:
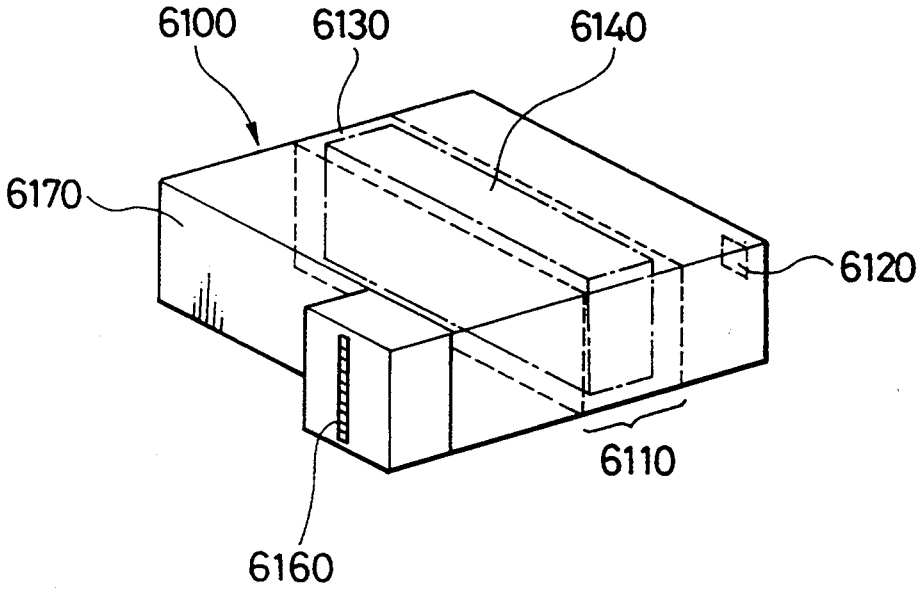
FIG. 14 is a schematic perspective view showing another embodiment of the recording head cartridge.

FIG. 14 is a schematic perspective view showing a recording head cartridge of second embodiment in which an ink tank and a recording head are integrally formed.

In FIG. 14, reference numeral 6110 denotes a movable wall, which is inserted into an ink tank 6100. The cross sectional area of the movable wall in a direction perpendicular to its moving direction is equal to or a little smaller than a cross sectional area of an ink storage portion. The movable wall is formed as follows: A surface of a colored resin 6140 (polyacetal: product name 'duracon' produced by the Polyplastic Co., Ltd) is coated with liquid oligomer 6130 (liquid isobutylene: product name 'bistanecks' produced by the Tonecks Co., Ltd) of some millimeters (mm) of film thickness. This movable wall is inserted into the ink tank 6100 which is formed by a transparent resin (polycarbonate: product name 'eubilon' produced by the Mitsubishi gasu kagaku Co., Ltd).

Similarly to first embodiment, the movable wall seals the ink storage portion in cooperation with the internal wall of the ink tank, and an air communicating port 6120 is provided on a side opposite the ink storage portion 6170 of the ink tank.

Ink which is composed of C.I. direct yellow 862, diethylene glycol 15, water 83 and so on, is packed into the ink storage portion 6170. The performance test of the recording head cartridge is done, either alone or at being mounted on an ink jet recording apparatus.

Figure 15:
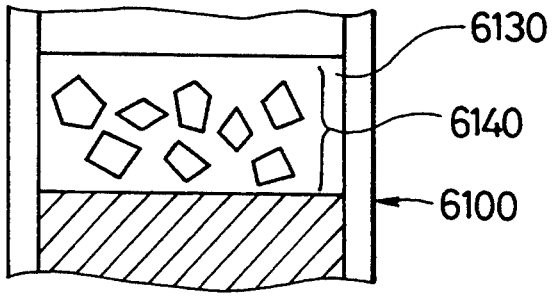
FIG. 15 is a schematic cross sectional view showing a part of still another embodiment of the ink storage member.

FIG. 15 is a schematic cross sectional view showing an ink tank of a modification of second embodiment. As a movable wall of this modification, a colored pellet-shaped resin 6140 (polyacetal: product name 'duracon' produced by the Polyplastic Co., Ltd) is contained in liquid oligomer 6130 (liquid isobutylene: product name 'bistanecks' produced by the Tonecks Co., Ltd), and the recording head cartridge is formed in the same manner as described above. The performance test of the ink jet cartridge is done, either alone or at being mounted on an ink jet recording apparatus.

As a movable wall of another modification, porous plastics (polyolefin resin: product name 'sunfine' produced by Ashahikasei Co., Ltd) are contained in liquid oligomer 6130 (liquid isobutylene: product name 'bistanecks' produced by the Tonecks Co., Ltd), and the recording head cartridge is formed in the same manner as described above. The performance test of the ink jet cartridge is done, either alone or at being mounted on an ink jet recording apparatus.

Figure 16:
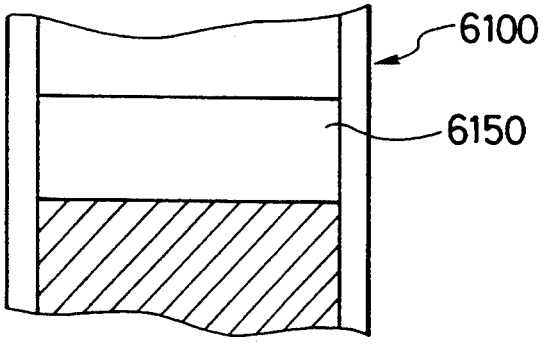
FIG. 16 is a schematic cross sectional view showing a part of still further embodiment of the ink storage member.

FIG. 16 is a schematic cross sectional view showing an ink tank of a further modification of the second embodiment. A recording head cartridge of the modification is formed of the same silicone rubber for movable wall materials as that of the embodiments in FIGS. 4A, 4B and 12, in a similar ink tank 6100 and a movable wall 6150 of the second embodiment and the modification thereof.

The performance tests of the recording head cartridges in accordance with the second embodiment and its modifications are as follows:

(1) mounting the recording head cartridge on the apparatus, and checking the ejection stability
(2) removing the recording head cartridge from the apparatus, and dropping the cartridge itself from 2 meters above ground level, and repeating the same
(3) re-mounting the cartridge on the apparatus itself, and re-checking the ejection stability
(4) continuing recording until the packed ink is completely used up As a result of the above performance tests, in any of the recording head cartridges, the movable wall is observed not to be destroyed, and the packed ink is determined to be completely used up.

In the above second embodiment and first two modifications, a movable wall which is formed of both oligomer with high viscosity at room temperature and arbitrary solid component, is used to form the ink tank of an ink jet recording apparatus, so that the ink tank where ink storage features such as anti-impact feature, anti-ink leakage feature and anti-ink vaporization feature, are superior, and which improves in an efficiency of stored-ink consumption, can be provided. Additionally, the configurations of the movable wall can be employed for the configuration of a plurality of ink chambers shown, for instance, in FIGS. 4A and 4B.

Moreover, since the movement of the movable wall can be observed externally by using a transparent ink tank case, means for detecting the remaining amount of ink is obtainable.

In the above second embodiment and modifications, a recording head and an ink tank are integrally formed as a cartridge type. However, the present invention is also applicable to an separate-type ink tank in which a recording head and an ink tank are divided by tubes or the like.

Figure 17:
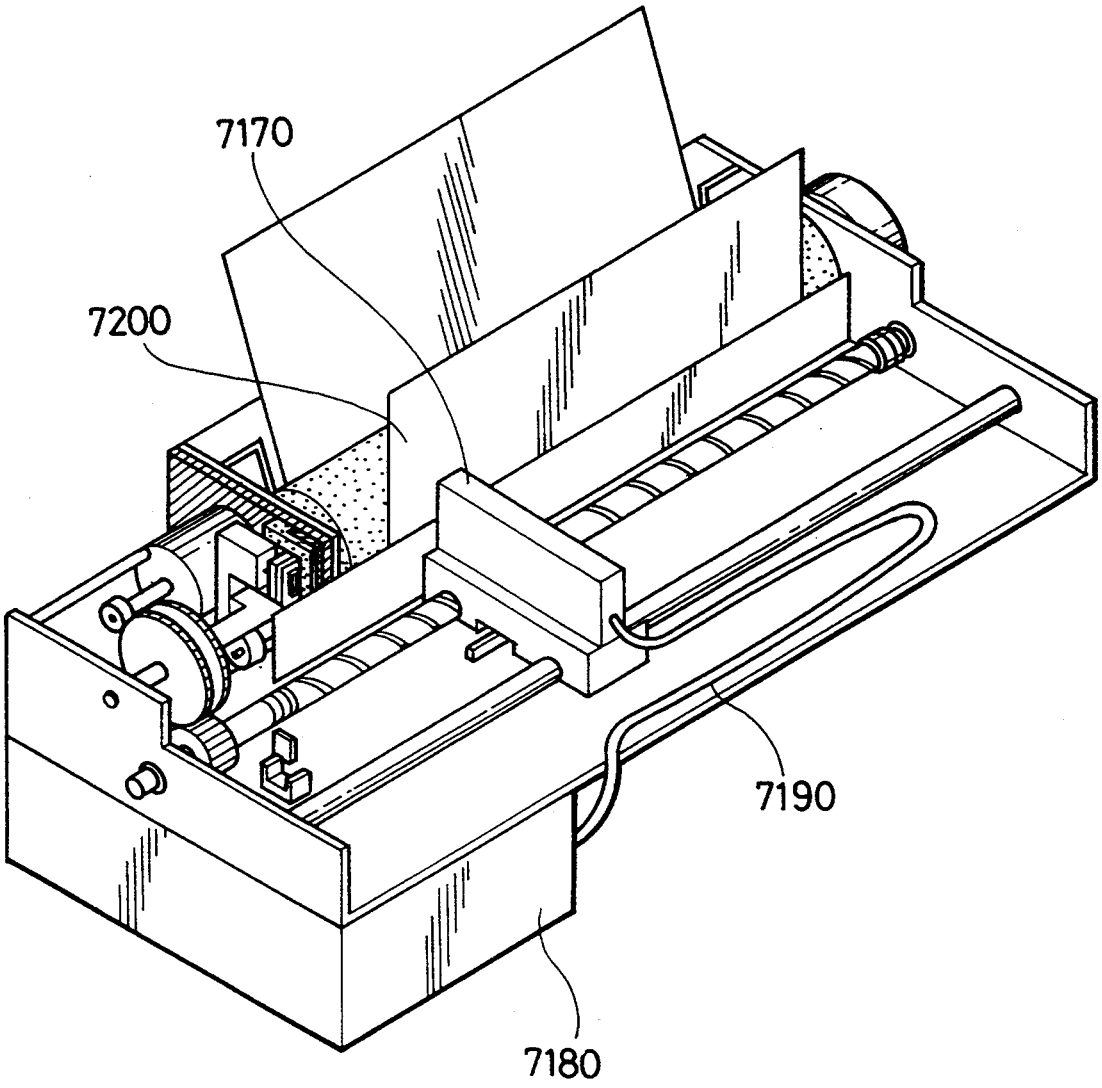
FIG. 17 is a schematic perspective view showing another embodiment of the ink jet recording apparatus which can use the ink storage member according to the present invention.

FIG. 17 is a view showing an ink jet recording apparatus using the above ink tank. This ink jet recording apparatus performs recording by scan movement of the recording head 7170, that is, the apparatus is a so-called serial-type recording apparatus. A flexible tube 7190 connecting an ink tank 7180 with a recording head 7170, is provided so that ink may be supplied according to the movement of the recording head 7170.

As more flexible rubber to be used to the movable wall of the above some embodiments, besides silicone rubber, natural rubber, isoprene rubber, butadiene rubber, chloroprene rubber, urethane rubber or the like is available.

As the oligomer with high viscosity at room temperature to be used to a movable wall of some above embodiments, besides the above described, liquid polypropylene, polypropylene glycol, oligoester acrylate, high molecular polybdenum, polyisobutylene, liquid chloroprene or the like is available.

In order to optimize the mobility of the movable wall comprising the liquid oligomer and the solid component, viscoelasticity additives, non-organic additives or the like can be added into the liquid oligomer to change liquid features. As a viscoelasticity additive, a compound of a metal soap of aluminum, barium, potassium, lead or the like and mineral oil is available. As the non-organic additives, calcium carbonate, clay, titanium oxide, carbon black or the like is available. Also aerojiru (product name 'aerojiru 200' produced by the Nihon aerojiru Co., Ltd) is available.

Moreover, since the-solid to be used with the liquid oligomer prevents the movable wall from being destroyed with respect to its shape, any-shaped solid can be used as long as the solid does not decrease the mobility of the movable wall.

In addition, the movable wall and the packed ink are not accepted to each other, but as a dye in ink to be used, most of dye, water soluble acid dye, direct dye, alkaline dye or reactive dye shown in the color index is usable. Dye not shown in the color index can be used as long as it is water soluble.

Though an amount of the dye to be used in ink of the present invention is not limited, in general, 0.1–20 wt percent, preferably 0.3–10 wt percent, more preferably 0.5–6 wt percent of the whole ink weight is available.

As a preferable medium to be used in the ink of the present invention, water or a mixed medium of water and a water soluble organic solvent is preferable, and the mixed medium of water and water soluble organic solvent is more preferable. As the water soluble organic solvent, a water soluble organic solvent containing polyhydric alcohol, which prevents ink from drying, is very preferable. As water, instead of common water containing various ions, demineralized water is preferable.

The content of the above water soluble organic solvent in ink is 2–80 wt percent, preferably 3–70 wt percent, and more preferably 4–40 wt percent of the whole ink weight in general.

Moreover, water to be used is over 35 wt %, and preferably 45 wt percent of whole ink weight.

Besides the above components, if necessary, antimold, preservatives, a pH modifier, a viscosity modifier, a capillary force modifier or the like can be added to the ink of the embodiment of the present invention.

The preferable ink state is as follows: the viscosity of the ink is 1–20 cP, and preferably 1–5 cP, the capillary force of the ink is over 30 dyne/cm, and preferably over 40 dyne/cm, and pH of the ink is 4–10.

In addition, in this embodiment, the ink comprises C.I. foodblack2, diethylene glycol, triethylene glycol, nonion surface active agent (product name: 'Nissan nonion P223' produced by the Nihonyushi Co., Ltd), and water.

In the above embodiments of the movable wall, a chamber separated by the movable wall, opposite to a chamber where ink is stored, communicates with air. The chamber does not necessarily communicate with air. For instance, when means for pressing the movable wall by a pressure corresponding to the atmospheric pressure, is provided, the effect of the present invention can be obtained.

Moreover, in the above embodiments, the ink tank to be used for the ink jet recording apparatus has been explained. The present invention is applicable to a tank to commonly store a liquid. It is clear that the movable wall of the present invention maintains a constant negative pressure in the process where a liquid (ink) flows into this tank.

THIRD EMBODIMENT

Figure 18:
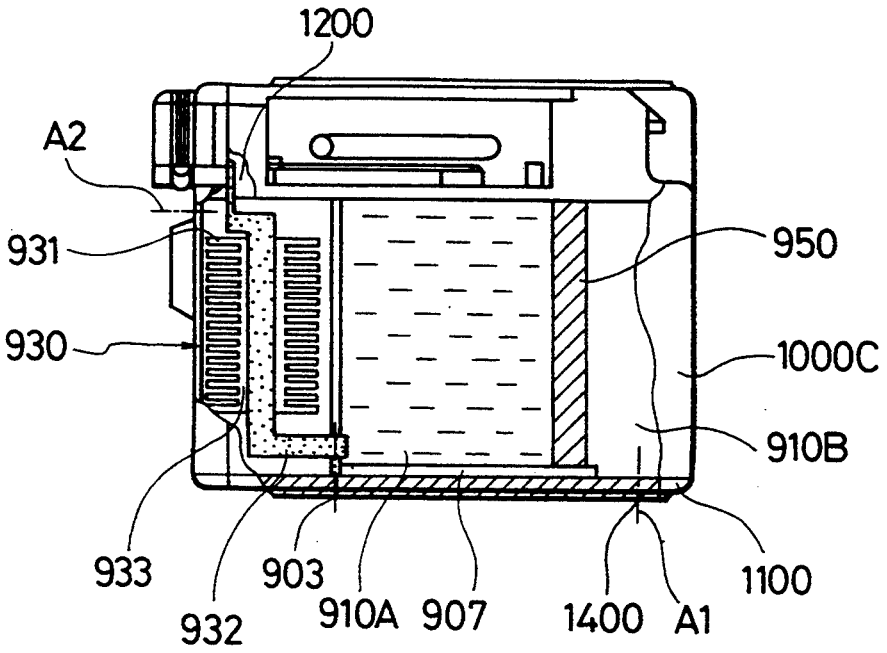
FIG. 18 is a plan view, partly in section, showing the recording head cartridge of a second embodiment of the present invention.

An ink tank of the third embodiment of the present invention, as shown FIG. 18, comprises a case 1000C, an ink temporary holding member 930, a movable wall 950 and a cover 1100.

A configuration of a recording head cartridge is similar to that of the first embodiment except for the ink tank.

The ink temporary holding member 930, which is disposed on an ink supply route from an ink storage chamber 910A in the ink tank to a recording head unit, can hold a part of ink supplied temporarily. Reference numeral 1200 denotes an ink inlet which is provided for supplying ink to the recording head unit IJU composed of the components denoted by reference numerals 100–600 as shown in FIG. 5.

The ink temporary holding member 930 holds ink temporarily according to a change in a pressure in the ink tank IT. The ink temporary holding member 930 comprises a plurality of circular thin portions or spiral thin portions 931, an ink guiding member 932, slit-shaped slots (not shown) and a communicating portion. The circular thin portions 931 have cross-sections which are comb-shaped, and which form slots for holding ink by a capillary force thereof. The ink guiding member 932 guides ink from the ink storage chamber 910A to the ink inlet 1200 on the recording head side. The slit-shaped slots are formed at a body 933 from which the circular thin portions 931 project and communicate with the above slots formed by the circular thin portions.

The ink holding member 930 is adjacent to the ink storage chamber 910A, and is disposed on an ink route between the ink storage chamber and the recording head unit IJU as described above. The ink temporary holding member. 930 is divided from the ink storage chamber, and the circumstance thereof communicates with air.

In this embodiment, in order to communicate with air, an air communicating port 1400 provided in a position indicated by A1 in FIG. 18 may be used. The port 1400 communicates with air through tube 907. Another air communicating port may be provided in a position indicated by A2. To the contrary, with respect to communication of the air chamber 910B, an air communicating port may be provided in a position indicated by A2 instead of the air communicating port 1400 provided at A1. In this case, the air communicating tube 907 is used for the air communicating of the air chamber 910B.

The air communicating port 907 can be also used as a rail for guiding the movement of the movable wall 950. Moreover, means for effectively preventing the increase in viscosity and solidification of ink, may be formed in an appropriate position, which is caused by vaporization of the ink solvent in the ink temporary holding member 930. For example, in the configuration where the air communicating port 1400 is provided in a position indicated by A1, and the air communicating tube 907 is provided, air outside the movable wall is also usable. That is, the air outside the movable wall may be made damp.

The ink storage chamber 910A of the ink tank is ink-sealed by the movable wall 950 slidable inside the ink tank, and is tightly sealed against air. The air chamber 910B separated by the movable wall 950, communicates with air via the air communicating port 1400 provided on the cover 1100. The movable wall 950 operates according to the principle shown in the above first embodiment. Consequently, the explanation of the movable wall 950 is omitted.

One end of the ink guiding member 932 at the ink temporary holding member 930 is inserted into an ink inlet 903 of the ink storage chamber 910A, and the other end of the ink guiding member 932 is connected to the ink inlet 1200 on the recording head unit side so that an ink supplying route is formed. Around the ink guiding member 932, the plurality of circular thin portions 931 are formed, and the slot between the circular thin portions 931 forms an ink temporary holding portion as described above.

With these configuration, the ink temporary holding member 930 can guide ink coming from the ink storage chamber 910A with the ink guiding member 932 and then can hold the ink in the thin portions according to a pressure on the ink in the ink storage chamber. In this embodiment, a clearance between the two neighboring thin portions, or the width of the slot, is set to be 0.08 mm. The narrower is the clearance, the greater becomes the capillary force. This causes a large holding force (a virtual negative pressure). Additionally, in the ink jet recording system, bubbles may penetrate ink supplying paths and may cause defective ink ejection. To prevent bubble penetration, this embodiment uses a fibrous converging body formed by a polyester fibrous floc for the ink guiding member 932 so that bubbles are prevented from penetrating ink supplying paths. Since the fibrous converging body is a floc of fine fiber tubes, bubbles hardly penetrate. As materials for the ink guiding member 932, a porous absorber such as urethane sponge or the like has the same effect.

In the ink supplying system described above, a holding force (including a virtual negative pressure by a capillary force) to hold ink is controlled mainly by the capillary force. More specifically, the ink supplying system is designed so that the orifices have the maximum holding force and the holding force decreases at the ink temporary holding member 930 formed by a plurality of the thin portions and the ink storage chamber 910A of the ink tank in this order. As the orifices, the ink temporary holding member 930 and the ink storage chamber 910A have the above relationship, ink is naturally supplied from the ink storage chamber to the orifices.

Since the holding force at each of the orifices is a capillary force of the ink path communicating with the orifice, the holding force is determined by the shape and the magnitude of the ink path. Moreover, since the holding force in the ink temporary holding member 930 is caused by a capillary force in the slots formed between the plurality of the thin portions 931 as described above, the holding force is determined by dimensions of the slots. It is preferable that the clearance size of the slots is larger on the ink storage chamber side than that at the orifice side. That is, it is preferable that the capillary force is smaller on the side of the ink storage chamber. As described above in first embodiment, the holding force in the ink storage chamber is determined by the friction force at the slide portion of the movable wall 950. The friction force is determined under the following conditions in the ink supplying system ranging from the ink storage chamber to the orifices: The conditions are non-movement of the movable wall against the attitude of the ink tank and external forces to be applied thereto or the like.

When environmental conditions change, e.g., a temperature of ink rises due to a recording action (heat of the electrothermal transducer), a pressure of ink stored in the ink storage chamber 910A or a pressure of a trace of air therein, temporarily increases. On the contrary, when a temperature of the ink falls, the pressure decreases. If the friction force at the slide portion of the movable wall 950 is appropriately set, the movable wall 950, however, can move according to the increase or the decrease in the pressure, so that the increase or the decrease in the pressure is absorbed, and then the pressure in the ink storage chamber can be maintained constant. Even if there is no environmental change, the pressure exerted on ink in the ink tank may be increased or decreased because of acceleration or deceleration of the carriage at its start or stop time.

When the pressure on the ink increases or decreases, the movable wall can move so as to increase or decrease the pressure in the ink tank respectively so that the pressure is maintained constant as described above. However, since the friction force of the movable wall is set to be a little larger under the various conditions described before, the movable wall may not move effectively for the pressure increase or decrease. As a result, the constant negative pressure cannot be maintained constant. In addition, the pressure fluctuation (pressure increase or decrease) in the ink storage member, which is transmitted to the recording head unit through the ink supply route, may not be absorbed, and then give an adverse effect to the ink ejection. In the ink jet recording apparatus, when the above pressure fluctuation is relatively large, an ink ejection amount changes so that a good quality of recording may not be obtained.

In this embodiment, to add to the configuration for maintaining the predetermined negative pressure by the movable wall, the ink temporary holding member 930 operates effectively.

More specifically, when the pressure on the ink in the ink storage chamber 910A increases, the negative pressure of the ink guiding member 932 becomes relatively small, and ink held by the ink guiding member 932 is pressed out into the ink temporary holding member 930. The pressed ink passes through the above described air communicating portion and the slots, 'and is held by the slots of the thin portions 931. To the contrary, when the pressure in the ink storage decreases, the negative pressure in the ink guiding member 932 becomes relatively large. Consequently, the ink held by the thin portions passes through the slots and the air communicating portion and returns to the ink storage chamber 910A.

As described above, when the pressure applied on the ink in the ink storage chamber increases or decreases according to the changes in the environment or the carriage operation conditions, the ink temporary holding member 930 operates as a buffer, so that the ink temporary holding member 930 can prevent an undesirable pressure from being transmitted to the orifices. As a result, the stable recording can be performed.

Incidentally, an ink solvent may vaporize from a part of the ink guiding member 932 located away from the thin portion, or bubbles may penetrate a part of the ink guiding member 932. When, for instance, ink comes from the thin portion 931 of the ink temporary holding member 930, passes through the ink guiding member 932 and returns to the ink storage chamber 910A, air may be taken from the circumference of the ink guiding member 932 and may penetrate the ink storage chamber 910A. The following is the preventive method: For example, the surface-treated ink guiding member 932 is used, or the ink guiding member 932 is coated. Moreover, the ink guiding member 932 is packed into a tube.

The top plate 1300 by which the ink paths are formed is made of anti-ink polysulfone, polyethersulfone, polyphenyleneoxide or polypropylene, and which is simultaneously integrally molded together with the orifice plate 400 in a metal mold. As to the thin portions 931 of the ink temporary holding member, an ABS resin is treated with hydrophilic processing to change into a porous ABS resin, which has a large capillary force and holds ink securely. The virtual negative pressure of the ink temporary holding member caused by the capillary force is determined by the width of the slots between the two neighboring thin portions 931. It is preferable that the width is 0.05–0.12 mm and the negative pressure produced is −20 to −130 mmAq.

Figure 19:
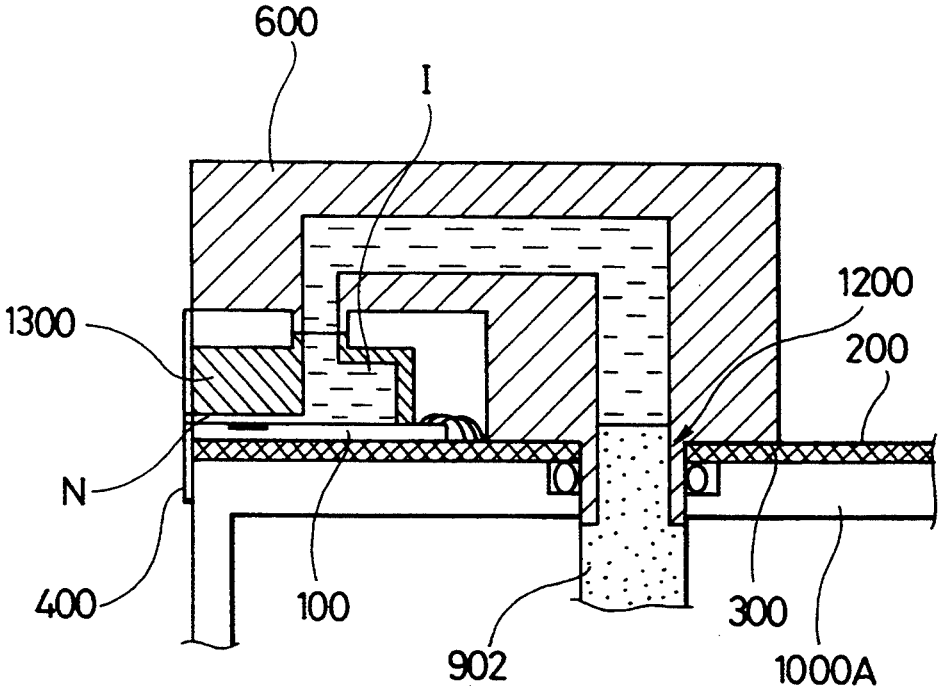
FIG. 19 is a cross sectional view showing an ink supplying system in the recording head unit of the recording head cartridge shown in FIG. 18.

As connection portions for communicating ink, for instance, a packing of silicone rubber or butyl rubber is disposed, which seals ink communicating portions and secures ink liquid paths. FIG. 19 is a schematic cross sectional view of an ink supply route of the recording head unit.

FOURTH EMBODIMENT

According to the present invention, besides the above configurations, various configurations can be made as shown below.

Figure 20:
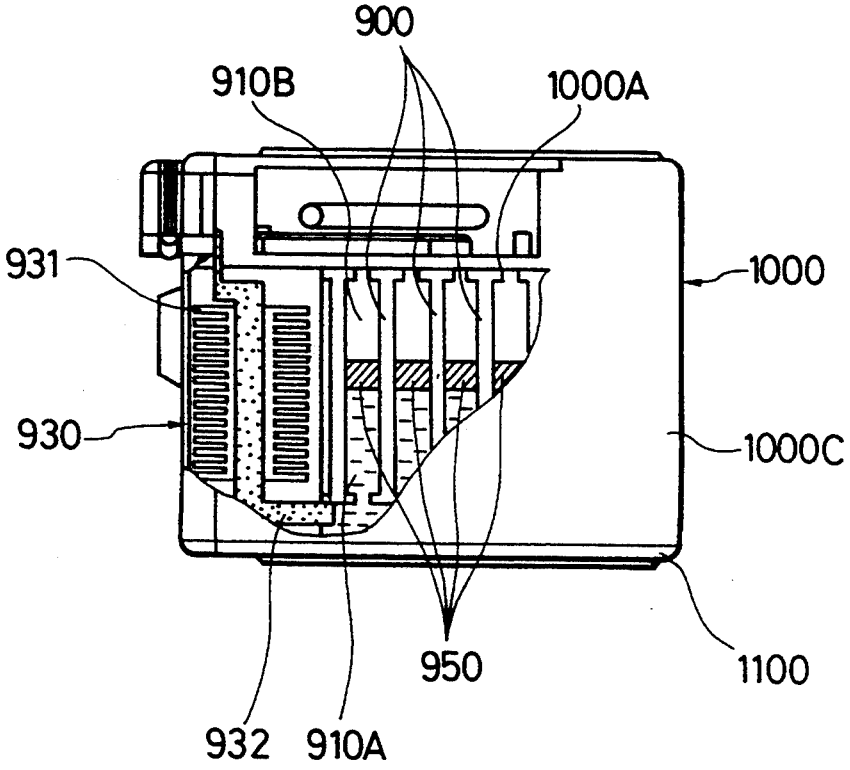
FIG. 20 is a plan view, partly in section, showing the recording head cartridge of a third embodiment of present invention.

FIG. 20 is a plan views, partly in section, showing a recording head cartridge of the fourth embodiment. In this embodiment, the inside of an ink tank is divided by a plurality of separation walls 900, and each portion is provided with a movable wall 950. The configuration is similar to that of the first embodiment shown in FIG. 4A.

It is assumed that an area through which each movable wall 950 contacts ink is 'S' an ink pressure head to each movable wall 950 is 'h', a static friction force at a slide portion of each movable wall 950 is 'F', and the limit on the holding force of an ink tank IT is within −15 gw. In FIG. 20, e.g., it is also assumed that an internal wall of a cartridge case 1000 is divided into 6 portions by the separation wall 900 and an area through which the movable wall 950 contacts ink is 15 $cm^2$, and ink is filled in an ink tank In this case, when the pressure head of ink which is received by the movable wall 950, is 3 gw, the static friction force F of the movable wall is obtained by expression:

$$4.5gw < F < 20gw$$

Figure 21:
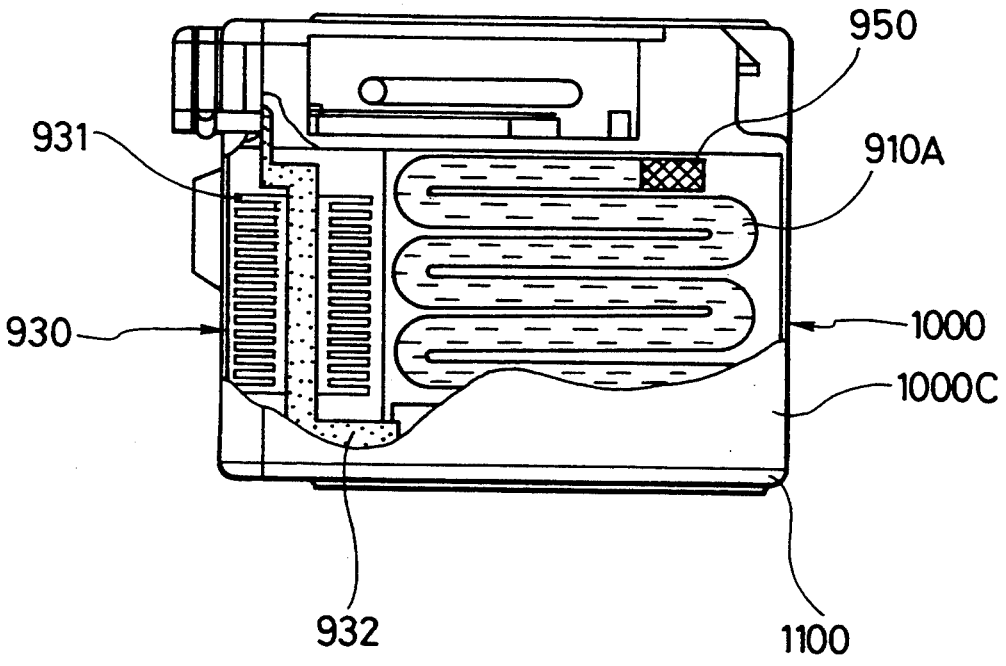
FIG. 21 is a plan view, partly in section, showing the recording head cartridge of a modification of the third embodiment of the present invention.

FIG. 21 is a plan view, partly in section, showing a recording head cartridge according to a modification of fourth embodiment. In this modification, an ink storage chamber (tube) 910A for storing ink is formed of tubular pipes. The ink storage chamber 910A is formed continuously together with an ink guiding member 932, and is sealed against air by a movable wall 950. As the recording head ejects ink and then ink in the ink storage chamber decreases, the movable wall 950 moves in the ink storage chamber 910A and the negative pressure is produced in the ink storage chamber 910A by a friction force caused at a slide portion of the movable wall 950. Other portions such as an ink temporary holding member 930 are the same as those of the other embodiments.

Figure 22:
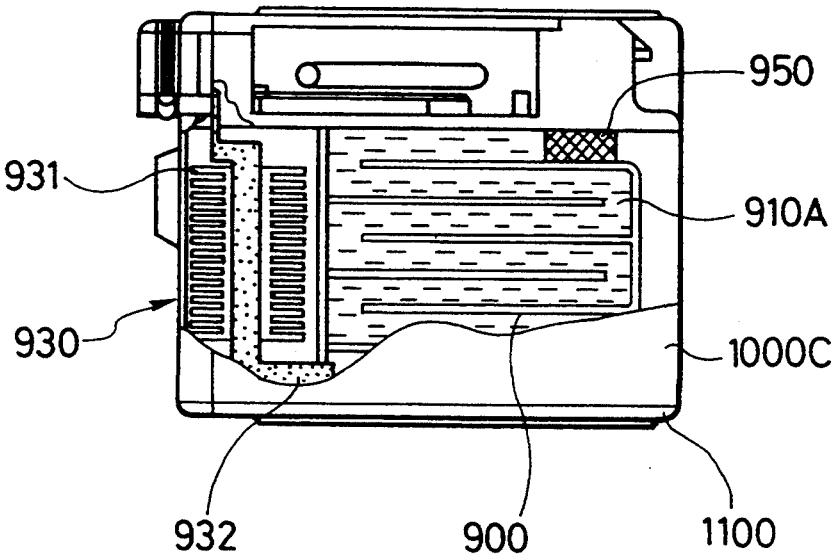
FIG. 22 is a plan view, partly in section, showing the recording head cartridge of another modification of the third embodiment.

FIG. 22 is a plan view, partly in section, showing a recording head cartridge of another modification of the fourth embodiment. In this modification, an ink storage chamber 910A for storing ink is formed by many fixed walls 900 provided in the ink tank. A viscosity float 950 moves in the ink storage chamber 910A formed by these fixed walls 900. Ink is sealed by the cartridge cover 1000C and the viscosity float 950 as a seal member, and is sealed against air. An external portion separated by the viscosity float 950 communicates with an air communicating port (not shown). As well as the moving wall 950, the viscosity float 950 moves in the ink storage chamber, and the negative pressure is produced in the ink storage chamber by a friction force at a slide portion of the viscosity float 950.

For example, materials of this viscosity float 950 are liquid polyprophylene, polyprophylene glycol, oligoester acrylate, high molecular bolybdenum, polyisobutylene or the like.

Figure 23:
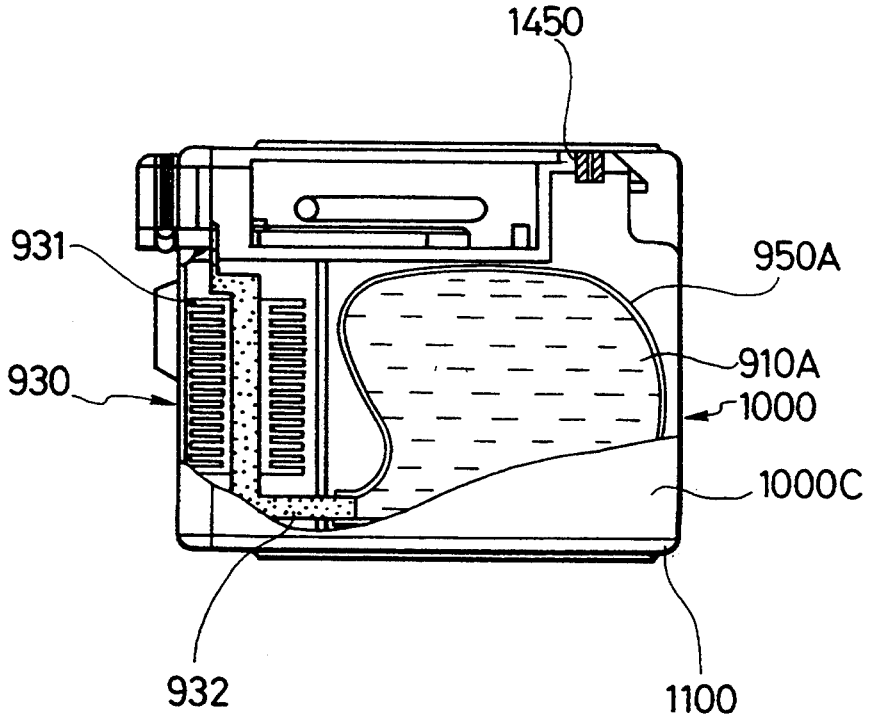
FIG. 23 is a plan view, partly in section, showing the recording head cartridge of still another modification of the third embodiment.

FIG. 23 is a plan view, partly in section, showing a recording head cartridge of still another modification of the configuration for generating the negative pressure in an ink tank of the present invention.

In the ink tank of this modification, an ink temporary storage member 930 and an ink storage bag 950A are provided. The ink storage bag 950A for storing ink is made of flexible materials such as rubber. An aperture of the ink storage bag 950A is connected to an ink guiding member 932 of the ink temporary holding member 930. In order that a change in a pressure in the ink storage bag 950A caused by the decrease of ink, may be made minimum, it is preferable that the ink storage bag 950A is approximately in a shape of a sphere. The circumference of the ink storage bag 950A communicates with air via an air communicating port 1450. With respect to the circumference of the ink storage bag 950A and air communication of the ink holding member 930, the same configuration as the fourth embodiment explained above can be used.

In the above configuration, in the initial state, the pressure in the ink storage bag 950A is a little lower than the atmospheric pressure so that ink is held. As ink decreases by ink ejection or the like, the pressure in the ink storage bag decreases and the negative pressure increases. However, the ink held in the ink temporary holding member 930 is discharged into ink supply route according to the increase of the negative pressure, and this makes influence due to the increase in the negative pressure small and then normal ink ejection can be performed.

Figure 24:
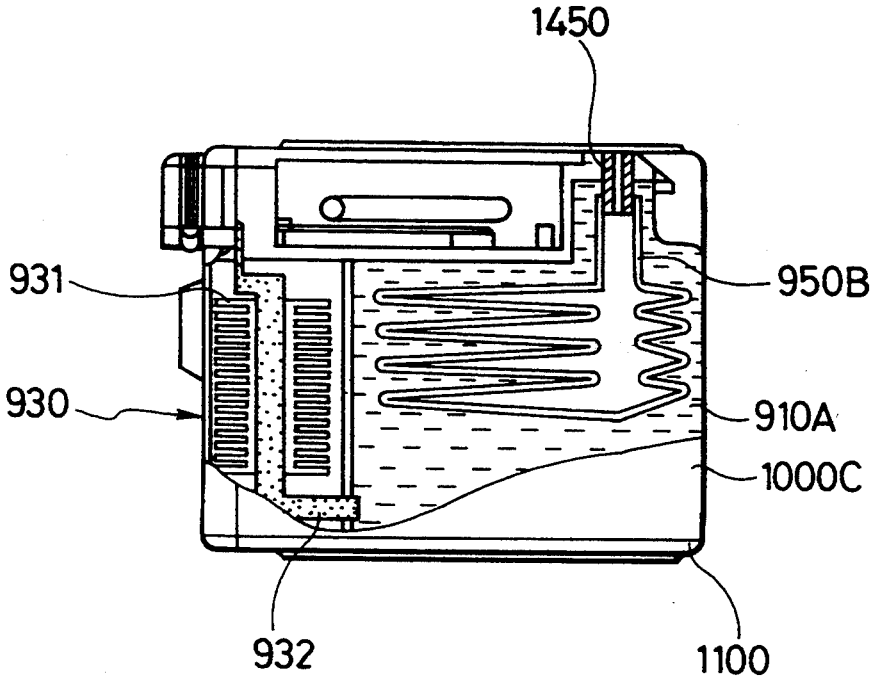
FIG. 24 is a plan view, partly in section, showing the recording head cartridge of still another modification of the third embodiment.

FIG. 24 is a plan view, partly in section, showing a recording head cartridge of still another modification.

In this modification, an ink storage chamber 910A is provided outside an air communicating bag 950B. More specifically, ink is directly stored in an ink tank, and the decease of the pressure in the ink storage chamber 910A caused by ink ejection, is absorbed by the air communicating bag 950B, which communicates with air. Incidentally, the bag 950B is made of elastic materials or the like so as to shrink toward the air communicating port. In this modification, since a shape of the ink storage chamber is not restricted by a movable wall or an ink storage member, a fairly large volume for storing ink can be obtained.

It is clear that the present invention is not limited to the above described fourth embodiment and its modifications, and that many configurations can be formed.

For instance, in the case where the recording head cartridge of the present invention is mounted in the state shown in FIGS. 18, 20, 21 and 22 during recording, a movable wall moves in an approximately horizontal plane. The configuration can be also made in such a way that the movable wall moves down vertically according to ink consumption. In this case, in order to effectively use up the remaining ink on a bottom of an ink storage chamber, an ink absorber is provided on the bottom of the ink storage chamber and is connected to an ink guiding member.

In the above embodiments and modifications, an ink tank and a recording head unit are integrally formed. According to the concept of the present invention, the ink tank and the recording head unit can be formed separately. Moreover, the ink tank may be of a fixed type, or it may move with the recording head unit.

Moreover, according to the concept of the ink jet recording apparatus of the present invention, the ink storage chamber, the ink temporary holding member and the recording head may be also formed separately, or any one of the ink storage chamber and the recording head may be formed separately.

As an ink temporary holding member, besides the above described ink temporary holding member comprising the thin portions, any shape of the ink holding member can be used. For example, slits are provided in a direction in which ink is supplied, or porous absorbers can be provided.

Moreover, for some ink composition, instead of the above described means for generating the negative pressure such as a movable wall or a bag, a configuration in which air is introduced into an ink storage chamber, or an amount of air increases according to ink consumption, is usable. In this configuration, a pressure in the ink storage chamber is adjusted by returning ink from the ink temporary holding member or by subsequently introducing air. The configuration for adjusting the pressure smoothly may be added to the ink temporary holding member. If air introduction through an ink guiding member is troubled, means for preventing the trouble may be added.

Figure 25:
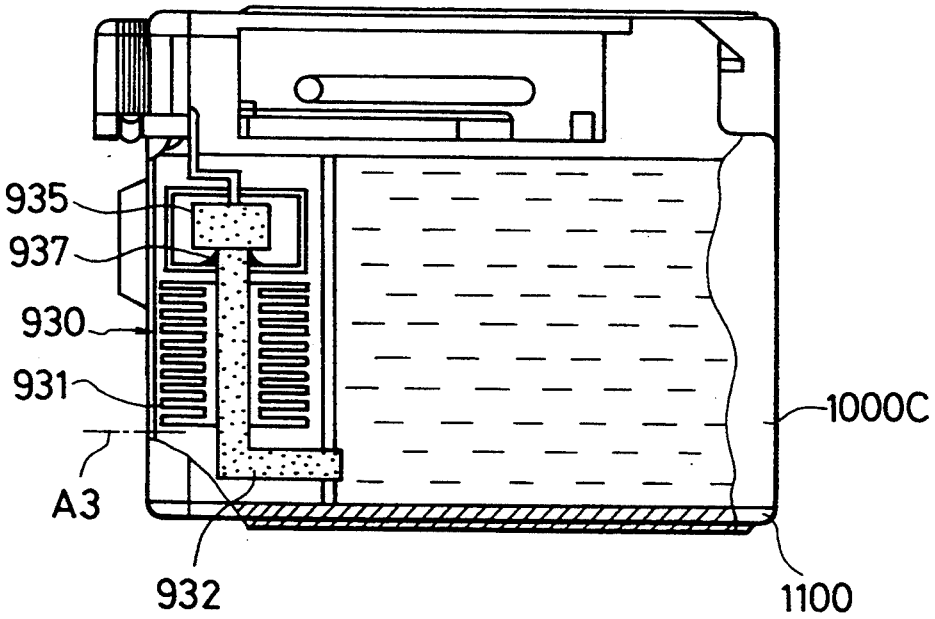
FIG. 25 is a plan view, partly in section, of the recording head cartridge of still another modification of the third embodiment.

Moreover, as means for securing the negative pressure for the recording head, for instance, an intermediate absorber 935 may be disposed between the ink temporary holding member 930 and the recording head, together with the movable wall or the bag, as shown in FIG. 25. In this configuration together with the movable wall or the bag, when the ink temporary holding member is formed, restriction on the accuracy thereof can be alleviated. As shown in FIG. 25, in the configuration where the ink temporary holding member having the intermediate absorber 935 is only provided, air can be introduced into the ink storage chamber, so that the ink storage chamber can be simplified in configurations and can be made at a low manufacturing cost.

In FIG. 25, the intermediate absorber 935 may be disposed in a closed space, and the configuration can be made in such a way that the high negative pressure in the recording head is maintained by compression. A connecting member 937 connects a tip of an ink guiding member 932 to the intermediate absorber 930, and seals the connection portion. An air communicating port for the ink temporary holding member 930 is provided in a position indicated by A3 in FIG. 25. If air introduction from the surface of the ink guiding member 932 is troubled, surface treatment can be made as mentioned above.

The present invention achieves distinct effect when applied to a recording head or a recording apparatus which has means for generating thermal energy such as electrothermal transducers or laser light, and which causes changes in the ink by the thermal energy so as to eject ink. This is because such a system can achieve a high density and high resolution recording.

A typical structure and operational principle thereof are disclosed in U.S. Pat. Nos. 4,723,129 and 4,740,796, and it is preferable to use these basic principles to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces a sudden temperature rise that exceeds the nucleate boiling so as to cause the film boiling on heating portions of the recording head; and third, bubbles are formed in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the thermoelectric transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, as an output device of a facsimile apparatus having a transmission and receiving function, and as an output device of an optical disc apparatus for recording and/or reproducing information into and/or from an optical disc. These apparatus requires means for outputting processed information in the form of hard copy.

Figure 26:
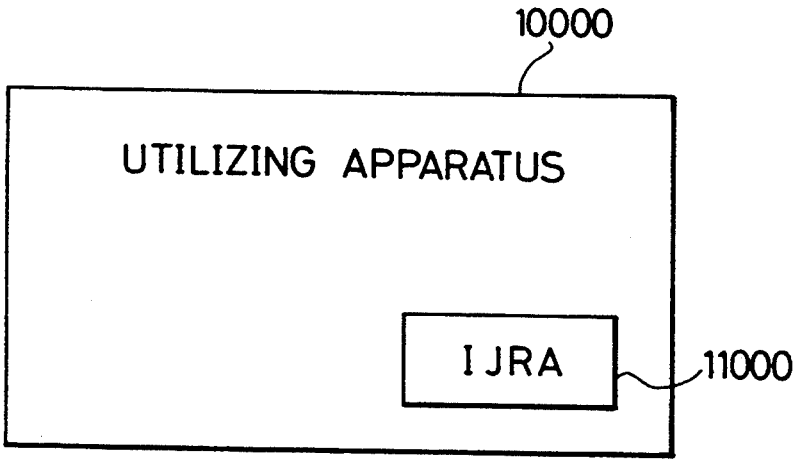
FIG. 26 is a schematic diagram illustrating an embodiment of an apparatus to which the ink jet recording apparatus in accordance with the present invention is equipped.

FIG. 26 schematically illustrates one embodiment of a utilizing apparatus in accordance with the present invention to which the ink jet recording system shown in FIG. 9 is equipped as an output means for outputting processed information.

In FIG. 26, reference numeral 10000 schematically denotes a utilizing apparatus which can be a work station, a personal or host computer, a word processor, a copying machine, a facsimile machine or an optical disc apparatus. Reference numeral 11000 denotes the ink jet recording apparatus (IJRA) shown in FIG. 9. The ink jet recording apparatus (IJRA) 11000 receives processed information form the utilizing apparatus 10000 and provides a print output as hand copy under the control of the utilizing apparatus 10000.

Figure 27:
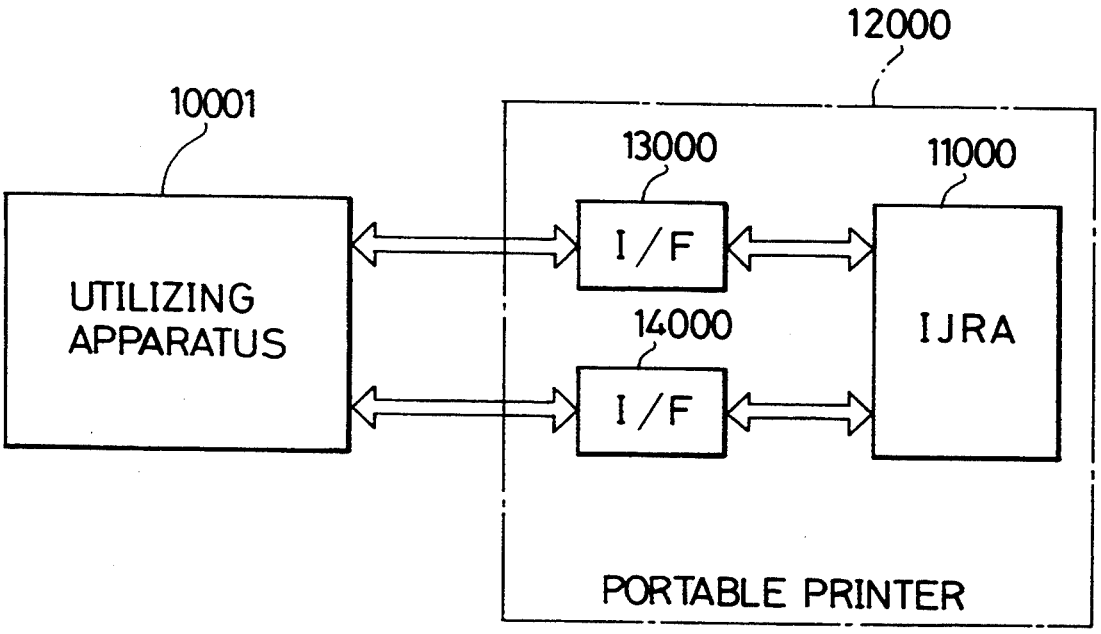
FIG. 27 is a schematic diagram illustrating an embodiment of a portable printer in accordance with the present invention.

FIG. 27 schematically illustrates another embodiment of a portable printer in accordance with the present invention to which a utilizing apparatus such as a work station, a personal or host computer, a word processor, a copying machine, a facsimile machine or an optical disc apparatus can be coupled.

In FIG. 27, reference numeral 10001 schematically denotes such a utilizing apparatus. Reference numeral 12000 schematically denotes a portable printer having the ink jet recording apparatus (IJRA) 11000 shown in FIG. 9 is incorporated thereinto and interface circuits 13000 and 14000 receiving information processed by the utilizing apparatus 11001 and various controlling data for controlling the ink jet recording apparatus 11000, including hand shake and interruption control from the utilizing apparatus 11001. Such control per se is realized by conventional printer control technology.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink storage unit used in an ink jet recording apparatus for recording by ejecting an ink, comprising:

a plurality of ink storage chambers for storing the ink;

a plurality of movable walls, each of said movable walls being provided in one of said ink storage chambers so as to seal the ink stored therein against air, wherein each of said movable walls can move according to a change in an amount of the stored ink; and a movable wall holding means for exerting on each of said movable walls an opposing force to oppose a force exerted thereon resulting from said change in the amount of the stored ink, so as to make a pressure in each of said ink storage chambers a negative pressure, said movable wall holding means having a configuration in which a corresponding one of said movable walls contacts a wall of a corresponding one of said chambers, wherein said opposing force includes a friction force caused by said contact, said friction force being equal to at least a sum of a weight of said corresponding one of said movable walls and a weight of the ink which is exerted on said corresponding one of said movable walls.

2. An ink storage unit as claimed in claim 1, wherein said ink storage unit is integrally formed with a recording head for ejecting the ink.

3. An ink storage unit as claimed in claim 1, wherein said ink storage unit is used in a state in which said ink storage unit is removably attached to a recording head for ejecting the ink.

4. An ink storage unit as claimed in claim 1, further comprising an ink temporary holding means for holding the ink, said temporary holding means being provided in an ink supply route communicating with said ink storage chambers and being used for holding the ink in said ink supply route.

5. An ink jet recording apparatus for recording by ejecting an ink, the apparatus comprising:

a recording head for ejecting ink;

an ink storage unit including:

a plurality of chambers for storing the ink to be supplied to said recording head, a plurality of movable walls, each of said movable walls being provided in one of said plurality of ink storage chambers so as to seal the ink stored therein against air, wherein each of said movable walls can move according to a change in an amount of the stored ink, and a movable wall holding means for exerting on each of said movable walls an opposing force to oppose a force exerted thereon resulting from said change in the amount of the stored ink, so as to make a pressure in each of said ink storage chambers a negative pressure, said movable wall holding means having a configuration in which a corresponding one of said movable walls contacts a wall of a corresponding one of said chambers, wherein said opposing force includes a friction force caused by said contact, said friction force being equal to at least a sum of a weight of said corresponding one of said movable walls and a weight of the ink which is exerted on said corresponding one of said movable walls; and signal sending means for sending an electric signal to said recording head to thereby eject the ink.

6. An ink jet recording apparatus as claimed in claim 3, wherein said recording head has a configuration in which heat energy produces bubbles in the ink and the ink is ejected by growth of said bubbles.

7. An ink jet recording apparatus for recording by ejecting ink, the apparatus comprising:

a recording head for ejecting ink;

an ink storage unit including:

a plurality of ink storage chambers for storing the ink for supply to said recording head, a plurality of movable walls, each of said movable walls being provided in one of said plurality of ink storage chambers so as to seal the ink stored therein against air, wherein each of said movable walls can move according to a change in an amount of the stored ink, and a movable wall holding means for exerting on each of said movable walls an opposing force to oppose a force exerted thereon resulting from said change in the amount of the stored ink, so as to make a pressure in each of said ink storage chambers a negative pressure, said movable wall holding means having a configuration in which a corresponding one of said movable walls contacts a wall of a corresponding one of said chambers, wherein said opposing force includes a friction force caused by said contact, said friction force being equal to at least a sum of a weight of said corresponding one of said movable walls and a weight of the ink which is exerted on said corresponding one of said movable walls;

an ink temporary holding means for holding the ink, said temporary holding means being provided in an ink supply route communicating with said ink storage chambers and being used for holding ink in said ink supply route; and signal sending means for sending an electric signal to said recording head to thereby eject the ink.

8. An ink jet recording apparatus as claimed in claim 7, wherein said recording head has a configuration in which heat energy produces bubbles in the ink and the ink is ejected by growth of said bubbles.

* * * * *

UNITED STATES PATENT AND TRADEMARK OFFICE

CERTIFICATE OF CORRECTION

PATENT NO. : 5,444,473

DATED : August 22, 1995

INVENTOR(S) : YOSHIFUMI HATTORI, ET AL.

It is certified that error appears in the above-identified patent and that said Letters Patent is hereby corrected as shown below:

ON TITLE PAGE

In [56] References Cited, under FOREIGN PATENT DOCUMENTS:
"2097498 4/1990 Japan
2293153 12/1990 Japan" should read
--2-97498 4/1990 Japan
2-293153 12/1990 Japan--.

COLUMN 1

Line 19, "by-recording" should read --by recording--.
Line 25, "la" should read --a--.
Line 54, "is" should read --are--.

COLUMN 2

Line 14, "port 1120," should read --port 120,--.
Line 48, "decreases" should read --decreases,--.
Line 63, "of a" should read --of--.
Line 65, "while" should read --during--.

COLUMN 3

Line 6, "Laying-Open" should read --Laid-open--.
Line 10, "Wall" should read --wall--.
Line 11, "contacts" should read --contact--.
Line 12, "on" should read --on the--.
Line 65, "high," should read --high, and--.

UNITED STATES PATENT AND TRADEMARK OFFICE

CERTIFICATE OF CORRECTION

PATENT NO. : 5,444,473

DATED : August 22, 1995

INVENTOR(S) : YOSHIFUMI HATTORI, ET AL.

It is certified that error appears in the above-identified patent and that said Letters Patent is hereby corrected as shown below:

COLUMN 4

Line 22, "chambers" should read --chamber--.
Line 42, "moves" should read --move--.
Line 52, "the" should be deleted and "force" should read --the force--.
Line 54, "being" should be deleted.

COLUMN 6

Line 1, "have" should read --have a--.
Line 17, "make" should read --make the-- and "the" should be deleted.
Line 29, "unit-comprising:" should read --unit comprising:--.

COLUMN 7

Line 30, "hereby" should read --thereby--.
Line 32, "unit is" should read --unit--.

COLUMN 8

Line 34, "of still" should read --of a still--.
Line 47, "pres-" should read --the pres- --.

COLUMN 9

Line 14, "an" should read --a--.

COLUMN 10

Line 5, "moldings" should read --molding--.

UNITED STATES PATENT AND TRADEMARK OFFICE

CERTIFICATE OF CORRECTION

PATENT NO. : 5,444,473

DATED : August 22, 1995

INVENTOR(S) : YOSHIFUMI HATTORI, ET AL.

It is certified that error appears in the above-identified patent and that said Letters Patent is hereby corrected as shown below:

COLUMN 11

Line 5, "its" should read --it is--.
Line 54, "communicates" should read --communicates with--.

COLUMN 12

Line 1, "is" (second occurrence) should read --are--.
Line 36, "ink-in" should read --ink in--.

COLUMN 13

Line 60, "engagic" should read --engageable--.

COLUMN 14

Line 58, "slides" should read --sides--.
Line 60, "is" should read --are--.

COLUMN 17

Line 5, "4001. (IV)" should read --4001. ¶ (IV)--.
Line 43, "mot or." should read --motor.--.

COLUMN 18

Line 41, "affected" should read --due to--.
Line 42, "by" should be deleted.

COLUMN 21

Line 14, "the-solid" should read --the solid--.

UNITED STATES PATENT AND TRADEMARK OFFICE

CERTIFICATE OF CORRECTION

PATENT NO. : 5,444,473

DATED : August 22, 1995

INVENTOR(S) : YOSHIFUMI HATTORI, ET AL.

It is certified that error appears in the above-identified patent and that said Letters Patent is hereby corrected as shown below:

COLUMN 23

Line 18, "configuration," should read --configurations,--.

COLUMN 24

Line 47, "'and" should read --and--.

COLUMN 25

Line 32, "views," should read --view,--.
Line 47, "15 $cm^2$," should read --1.5 $cm^2$,--.
Line 48, "tank In" should read --tank. In--.
Line 56, "of" should read --of the--.

COLUMN 28

Line 44, "Laying-open" should read --Laid-open--.
Line 57, "consists" should read --consist--.

COLUMN 29

Line 52, "Laying-open" should read --Laid-open--.
Line 65, "requires" should read --require--.

COLUMN 30

Line 11, "form" should read --from--.
Line 12, "hand copy" should read --hard copy--.

UNITED STATES PATENT AND TRADEMARK OFFICE

CERTIFICATE OF CORRECTION

PATENT NO. : 5,444,473

DATED : August 22, 1995

INVENTOR(S) : YOSHIFUMI HATTORI, ET AL.

It is certified that error appears in the above-identified patent and that said Letters Patent is hereby corrected as shown below:

COLUMN 31

Line 41, "3," should read --5,--.

Signed and Sealed this

Sixteenth Day of April, 1996

Bruce Lehman

BRUCE LEHMAN

*Commissioner of Patents and Trademarks*

*Attest:*

*Attesting Officer*